US009235154B2

(12) United States Patent
Suhara et al.

(10) Patent No.: US 9,235,154 B2
(45) Date of Patent: Jan. 12, 2016

(54) IMAGE FORMING METHOD OF EXPOSING THE SURFACE OF AN IMAGE CARRIER WITH LIGHT AND IMAGE FORMING APPARATUS

(71) Applicants: Hiroyuki Suhara, Kanagawa (JP); Hiroaki Tanaka, Kanagawa (JP); Kohji Sakai, Tokyo (JP)

(72) Inventors: Hiroyuki Suhara, Kanagawa (JP); Hiroaki Tanaka, Kanagawa (JP); Kohji Sakai, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/451,815

(22) Filed: Aug. 5, 2014

(65) Prior Publication Data

US 2015/0042740 A1 Feb. 12, 2015

(30) Foreign Application Priority Data

Aug. 8, 2013 (JP) ..... 2013-164932

(51) Int. Cl.
*B41J 2/47* (2006.01)
*G03G 15/043* (2006.01)

(52) U.S. Cl.
CPC ..... *G03G 15/043* (2013.01)

(58) Field of Classification Search
USPC ..... 347/115, 131, 240, 251–254
See application file for complete search history.

(56) References Cited

U.S. PATENT DOCUMENTS

| | | | | |
|---|---|---|---|---|
| 6,271,868 | B1 * | 8/2001 | Kashihara | 347/115 |
| 8,143,603 | B2 | 3/2012 | Suhara et al. | |
| 8,441,513 | B2 | 5/2013 | Sakai | |
| 2005/0179971 | A1 | 8/2005 | Amada et al. | |
| 2006/0077500 | A1 | 4/2006 | Hayashi et al. | |
| 2006/0187294 | A1 | 8/2006 | Saisho et al. | |
| 2007/0091398 | A1 | 4/2007 | Ueda et al. | |
| 2007/0211324 | A1 | 9/2007 | Sakai et al. | |
| 2007/0211326 | A1 | 9/2007 | Saisho et al. | |
| 2007/0253048 | A1 | 11/2007 | Sakai et al. | |
| 2008/0024589 | A1 | 1/2008 | Ueda et al. | |
| 2008/0025759 | A1 | 1/2008 | Ichii et al. | |
| 2008/0055692 | A1 | 3/2008 | Saisho et al. | |
| 2008/0056746 | A1 | 3/2008 | Suhara | |
| 2008/0068689 | A1 | 3/2008 | Saisho et al. | |
| 2008/0068693 | A1 | 3/2008 | Hayashi et al. | |

(Continued)

FOREIGN PATENT DOCUMENTS

| | | | | |
|---|---|---|---|---|
| JP | 01069370 A * | 3/1989 | | B41J 3/21 |
| JP | 09-085982 | 3/1997 | | |

(Continued)

OTHER PUBLICATIONS

U.S. Appl. No. 13/721,099, filed Dec. 20, 2012.
U.S. Appl. No. 14/174,205, filed Feb. 6, 2014.

*Primary Examiner* — Hai C Pham
(74) *Attorney, Agent, or Firm* — Oblon, McClelland, Maier & Neustadt, L.L.P.

(57) ABSTRACT

An image forming method includes: exposing a surface of an image carrier with a light based on an image pattern including an image portion and a non-image portion to form an electrostatic latent image corresponding to the image pattern. The image portion is made up of a plurality of pixels. Some of the pixels that make up the image portion are exposed with light of a first output value that is higher than a prescribed optical output value when the entire pixels corresponding to the image portion are exposed over a prescribed time period.

9 Claims, 39 Drawing Sheets

(56) References Cited

U.S. PATENT DOCUMENTS

| | | | |
|---|---|---|---|
| 2008/0170282 | A1 | 7/2008 | Amada et al. |
| 2009/0002792 | A1 | 1/2009 | Sakai et al. |
| 2009/0051982 | A1 | 2/2009 | Suhara |
| 2009/0220256 | A1 | 9/2009 | Suhara et al. |
| 2009/0302218 | A1 | 12/2009 | Suhara |
| 2010/0196052 | A1 | 8/2010 | Suhara |
| 2011/0228368 | A1 | 9/2011 | Sakai et al. |
| 2012/0059612 | A1 | 3/2012 | Suhara et al. |

FOREIGN PATENT DOCUMENTS

| | | |
|---|---|---|
| JP | 2004-181868 | 7/2004 |
| JP | 2005-193540 | 7/2005 |
| JP | 3733166 | 10/2005 |
| JP | 2006-344436 | 12/2006 |
| JP | 2007-190787 | 8/2007 |
| JP | 2009-222754 | 10/2009 |

* cited by examiner

TWO-ISOLATED DOT PATTERN

TWO-BY-TWO PATTERN

|Vacc|≥|Vp|

|Vacc|<|Vp|

IMAGE FORMING METHOD OF EXPOSING THE SURFACE OF AN IMAGE CARRIER WITH LIGHT AND IMAGE FORMING APPARATUS

CROSS-REFERENCE TO RELATED APPLICATION(S)

The present application claims priority to and incorporates by reference the entire contents of Japanese Patent Application No. 2013-164932 filed in Japan on Aug. 8, 2013.

BACKGROUND OF THE INVENTION

1. Field of the Invention

The present invention relates to an image forming method and an image forming apparatus.

2. Description of the Related Art

There have recently been increased demands for high image quality and high stability in the electrophotography process of an image forming method.

Exemplary ways to improve the image quality in the electrophotography process include a method for reducing the exposure beam diameter. A smaller exposure beam diameter allows smaller electrostatic latent images to be formed, so that a higher resolving power can be achieved.

When an electrostatic latent image is formed with a smaller exposure beam diameter, however, not only the image height can be controlled less easily, but also the costs are increased.

The cost for controlling the image height of electrostatic latent images formed with a smaller exposure beam diameter comes to occupy a higher proportion of the entire costs of the image forming apparatus.

Thus, in the electrophotography process, an alternative for forming very small electrostatic latent images without reducing the exposure beam diameter has been sought for.

Furthermore, in the conventional image forming method, the height of attached toner on a line image, that is, the pile height of a line image is different from that on a solid image. Such a difference in the pile heights is caused by a difference in the sizes of the electrostatic latent images of these images.

In consideration of the demand for improved image quality and the demand for reduction in the environmental burden, the pile height needs to be controlled to an appropriate level.

The pile heights of line images and solid images may be controlled by performing some process in the developing process.

To control the pile height in the developing process, however, the latent images of a line image and a solid image need to be developed at different sensitivities because the electrostatic latent images of a line image and a solid image are different in size.

This method for controlling the pile height by developing the latent images of a line image and a solid image at different sensitivities is not preferable, because such a method causes some defects, e.g., lost faithfulness, in the resultant latent images.

An image forming method for controlling the pile height without performing any process in the developing process is therefore desirable. Desired in an image forming method is a way in which an electrostatic latent image is formed in such a manner that any variation resulting from the electrophotography process, without limitation to the pile height, is compensated.

A technique is disclosed in which, when the area of an input image is smaller than a predetermined size in an image forming method, the exposure energy per unit pixels is increased from a level used when written is a solid image (Japanese Patent Application Laid-open No. 2005-193540, for example).

Another exemplary technology disclosed in Japanese Patent Application Laid-open No. 2007-190787 corrects the image data by removing some pixels from or adding some pixels to the image to be exposed so that the optical energy output from each light source becomes uniform.

In an image forming method, there is also a demand for output images allowing very small characters, particularly outlined character images, that is, outline characters, in a size of two or three points to be recognized at a high dot density, e.g., at 1200 dpi.

While some improvements have been made in the developing, the transfer, and the fixing processes of the image forming method to allow high quality images to be output at a high dot density, such outputting of high-quality image has still been difficult.

While micron-order measurements of electrostatic latent images have been conventionally difficult, such measurements can now be conducted highly precisely. Such measurements have uncovered that a latent image, which is an image before development, was a cause of image quality deterioration in the image forming process.

In other words, uncovered by the measurements was that, when output as an image pattern was an outlined image, the electric field vector in the latent image in a direction perpendicular to the sample was not exactly the reverse of the electric field vector in the latent image of the ordinary image, and the vector in the outlined image was smaller than that intended in the image pattern.

In other words, when a very small image is to be output at a high dot density, a latent image resulting from an image pattern signal supplied from the controller does not match the image pattern. This means that high quality image outputs would be still difficult even if any improvements in the developing, transferring, and fixing processes are made in an image forming method.

The inventors of the present invention also found out that an effective way to output images of outlined characters, in particular, at high image quality is to increase the electric field vector in the latent image in the direction perpendicular to the sample toward the side not causing the toner to be attached.

From the view point of electromagnetism, the simplest way to increase the electric field in a white part of an image is to increase the amount of electric charge in the white part, but it is difficult to increase a local amount of electric charge.

It is therefore desirable for such a process to be performed easily without requiring any special process such as edge detection or character information recognition in an image forming method, without being affected by image information such as that of an outlined image.

There is a need to provide an image forming method capable of forming a high-quality image by controlling an electrostatic latent image.

SUMMARY OF THE INVENTION

It is an object of the present invention to at least partially solve the problems in the conventional technology.

An image forming method includes: exposing a surface of an image carrier with a light based on an image pattern including an image portion and a non-image portion to form an electrostatic latent image corresponding to the image pattern. The image portion is made up of a plurality of pixels. Some of the pixels that make up the image portion are exposed with light of a first output value that is higher than a prescribed optical output value when the entire pixels corresponding to the image portion are exposed over a prescribed time period.

An image forming apparatus forms an electrostatic latent image corresponding to an image pattern including an image portion made up of a plurality of pixels and a non-image portion by exposing a surface of an image carrier with light based on the image pattern. The image forming apparatus includes: a light source that outputs the light; a light source driving unit that generates a light source driving current for driving the light source; and an optical system that guides the light output from the light source to the latent image carrier. The light source driving unit generates the light source driving current such that some of the pixels making up the image portion is exposed with light of a first optical output value that is higher than a prescribed optical output value when the entire pixels corresponding to the image portion are exposed over a prescribed time period.

An image forming method includes: exposing a surface of an image carrier with light based on an image pattern including an image portion and a non-image portion to form an electrostatic latent image corresponding to the image pattern. The image portion is made up of a plurality of pixels. Some of the pixels making up the image portion are exposed with a higher optical output value and for a shorter time than one adjacent pixel.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Some embodiments of an image forming method according to the present invention and an image forming apparatus according to the present invention executing the image forming method will now be described with reference to some drawings.

Structure of Image Forming Apparatus

To begin with, the image forming apparatus according to the present invention will be explained.

Figure 1:
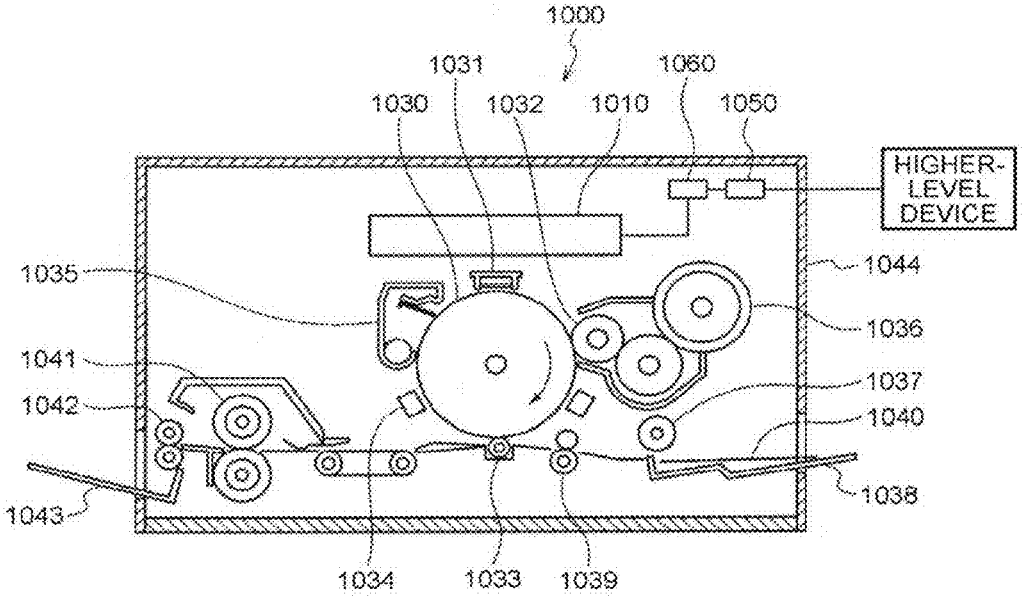
FIG. 1 is a cross-sectional view across the center of an image forming apparatus according to an embodiment of the present invention.

FIG. 1 is a cross-sectional view across the center of the image forming apparatus according to the embodiment. Illustrated in FIG. 1 is a general structure of a laser printer 1000 serving as the image forming apparatus according to the present invention.

The laser printer 1000 includes an optical scanning device 1010, a photosensitive element 1030, a charging device 1031, a developing device 1032, a transfer device 1033, a neutralization unit 1034, a cleaning unit 1035, and a toner cartridge 1036.

The laser printer 1000 also includes a sheet feeding roller 1037, a sheet feeding tray 1038, a fixing device 1041, a sheet discharge roller 1042, a sheet discharge tray 1043, a communication controlling device 1050, and a printer controlling device 1060.

These elements of the laser printer 1000 are housed in a printer housing 1044, at their predetermined positions.

The communication controlling device 1050 controls bidirectional communications with a higher-level device (e.g., an information processing apparatus such as a personal computer) over a network or the like.

The printer controlling device 1060 includes a central processing unit (CPU) and a read-only memory (ROM) not illustrated. The printer controlling device 1060 also includes a random access memory (RAM) and an analog-to-digital (A/D) converter. The printer controlling device 1060 controls these elements comprehensively in response to a request from the higher-level device, and transmits image information received from the higher-level device to the optical scanning device 1010.

The ROM stores therein computer programs described in codes readable by the CPU, and various types of data used when these computer programs are executed.

The RAM is a working memory for the CPU and is enabled for temporary writing.

The A/D converter converts analog signals into digital signals.

The photosensitive element 1030 is a latent image carrier made from a cylindrical member, and on the surface of which a photosensitive layer is formed. In other words, the surface of the photosensitive element 1030 is a surface to be scanned. The photosensitive element 1030 is rotated in the direction of the arrow in FIG. 1, by a driving mechanism not illustrated.

The charging device 1031 uniformly charges the surface of the photosensitive element 1030. As the charging device 1031, a contact-based charging roller that produces less ozone, or a corona charger taking advantage of corona discharge may be used, for example.

Figure 2:
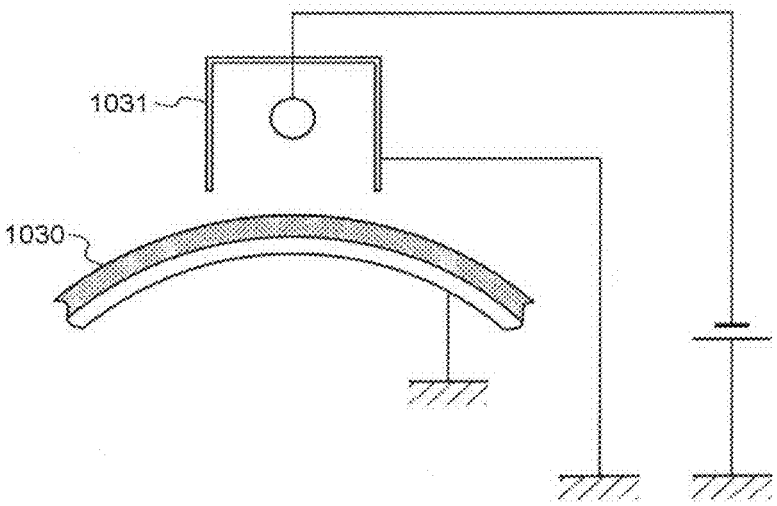
FIG. 2 is a schematic illustrating a corotron charger for the image forming apparatus.
Figure 3:
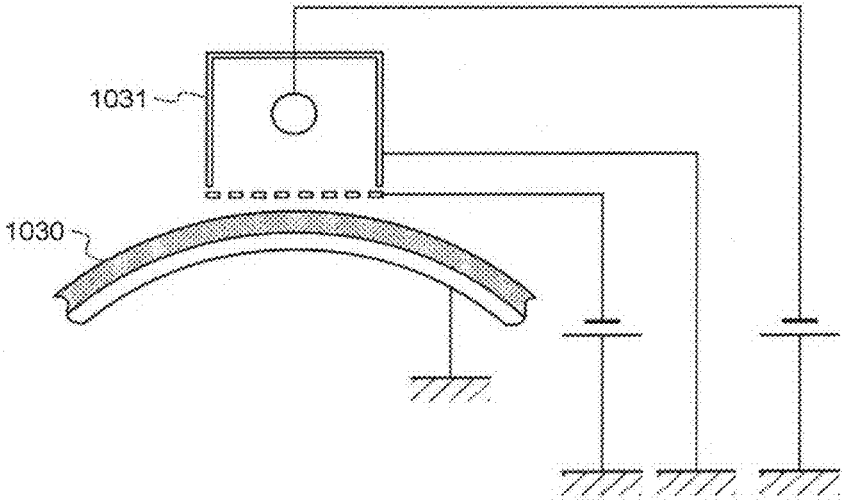
FIG. 3 is a schematic illustrating a scorotron charger for the image forming apparatus.

FIG. 2 is a schematic illustrating a corotron charger for the image forming apparatus. FIG. 3 is a schematic illustrating a scorotron charger for the image forming apparatus. The charging device 1031 may be any of the corotron charger illustrated in FIG. 2, the scorotron charger illustrated in FIG. 3, or a roller charger not illustrated.

The optical scanning device 1010 scans to expose the surface of the photosensitive element 1030 charged by the charging device 1031, with a light beam having modulated based on image information received from the printer controlling device 1060, thereby forming an electrostatic latent image corresponding to the image information on the surface of the photosensitive element 1030.

The electrostatic latent image formed by the optical scanning device 1010 moves toward the developing device 1032 as the photosensitive element 1030 is rotated. The optical scanning device 1010 will be described later in detail.

The toner cartridge 1036 stores therein a toner (developer). The toner is supplied from the toner cartridge 1036 into the developing device 1032.

The developing device 1032 attaches the toner supplied from the toner cartridge 1036 onto the latent image formed on the surface of the photosensitive element 1030, visualizing the electrostatic latent image thereby. The image on which the toner is attached (hereinafter, sometimes referred to as a "toner image") moves toward the transfer device 1033 as the photosensitive element 1030 is rotated.

The sheet feeding tray 1038 stores therein recording sheets 1040. The sheet feeding roller 1037 is provided near the sheet feeding tray 1038.

The sheet feeding roller 1037 takes out a recording sheet 1040 at a time from the sheet feeding tray 1038. The recording sheet 1040 is fed into the nip between the photosensitive element 1030 and the transfer device 1033 from the sheet feeding tray 1038, in synchronization with the rotation of the photosensitive element 1030.

Applied to the transfer device 1033 is a voltage with an opposite polarity to that of the toner so that the toner on the surface of the photosensitive element 1030 is electrically attracted to the recording sheet 1040. This voltage causes the toner image on the surface of the photosensitive element 1030 to transfer onto the recording sheet 1040. The recording sheet 1040 having the toner image transferred is sent to the fixing device 1041.

The fixing device 1041 applies heat and pressure to the recording sheet 1040, thereby fixing the toner on the recording sheet 1040. The recording sheet 1040 having the toner fixed is then sent to the sheet discharge tray 1043 via the sheet discharge roller 1042, and is sequentially stacked on the sheet discharge tray 1043.

The neutralization unit 1034 neutralizes the surface of the photosensitive element 1030.

The cleaning unit 1035 removes the toner remaining on the surface of the photosensitive element 1030 (residual toner). The surface of the photosensitive element 1030 from which the remaining toner is removed is returned to the position facing the charging device 1031.

In the image forming apparatus according to the present invention, an electrostatic latent image is formed by the charging device, the optical scanning device serving as an exposing device, the photosensitive element, and an image processor that converts an image pattern into an optical output.

The process of outputting an image in the electrophotography such as in a copier or a laser printer is as follows. In other words, in the electrophotography, the photosensitive element, which is a latent image carrier, is uniformly charged in the charging process. In the electrophotography, the charge is partly discharged by irradiating the photosensitive element with light in the exposure process. In this manner, an electrostatic latent image is formed on the photosensitive element in the electrophotography.

Structure of Optical Scanning Device

The following describes a structure of the optical scanning device 1010 in the image forming apparatus.

Figure 4:
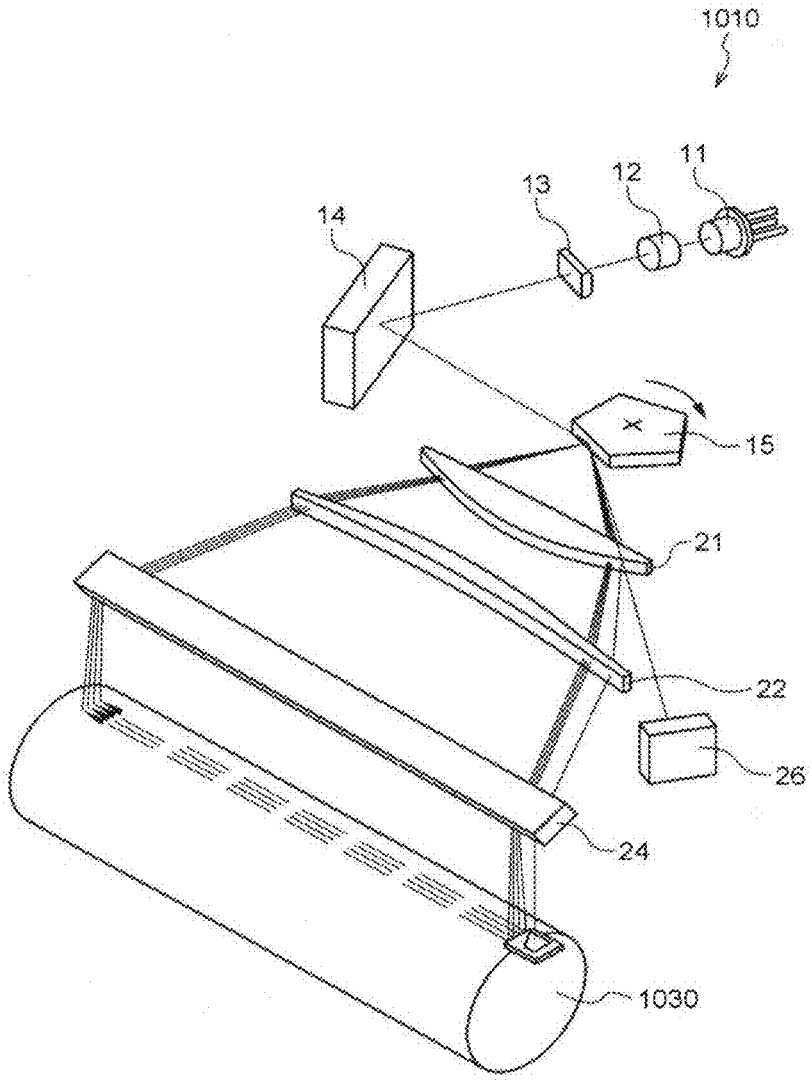
FIG. 4 is a schematic illustrating an optical scanning device in the image forming apparatus.

FIG. 4 is a schematic illustrating the optical scanning device 1010 in the image forming apparatus. As illustrated in FIG. 4, the optical scanning device 1010 includes a light source 11, a collimator lens 12, a cylindrical lens 13, a folding mirror 14, a polygon mirror 15, and a first scanning lens 21. The optical scanning device 1010 also includes a second scanning lens 22, a folding mirror 24, a synchronization detection sensor 26, and a scanning control device (not illustrated).

The optical scanning device 1010 is assembled to a predetermined position in an optical housing (not illustrated).

In the description hereunder, the longitudinal direction of the photosensitive element 1030 (rotating shaft direction) is referred to as the Y-axial direction in an X-Y-Z three-dimensional Cartesian coordinate system, and the direction extending along the rotating shaft of the polygon mirror 15 is referred to as the Z-axial direction, and the direction perpendicular to the Y axis and to the Z axis is referred to as the X-axial direction.

In the explanation hereunder, the direction corresponding to the main-scanning direction of the optical members is referred to as a "main-scanning corresponding direction", and the direction corresponding to the sub-scanning direction is referred to as a "sub-scanning corresponding direction".

The light source 11 includes a plurality of light-emitting elements (not illustrated) that are arranged two dimensionally, for example. The light-emitting elements are arranged in such a manner that the light-emitting elements are spaced at equal intervals when all of the light-emitting elements are orthographically projected onto a virtual line extending in the sub-scanning corresponding direction.

As the light source 11, semiconductor lasers (laser diodes (LDs)) or light emitting diodes (LEDs) may be used.

Figure 5:
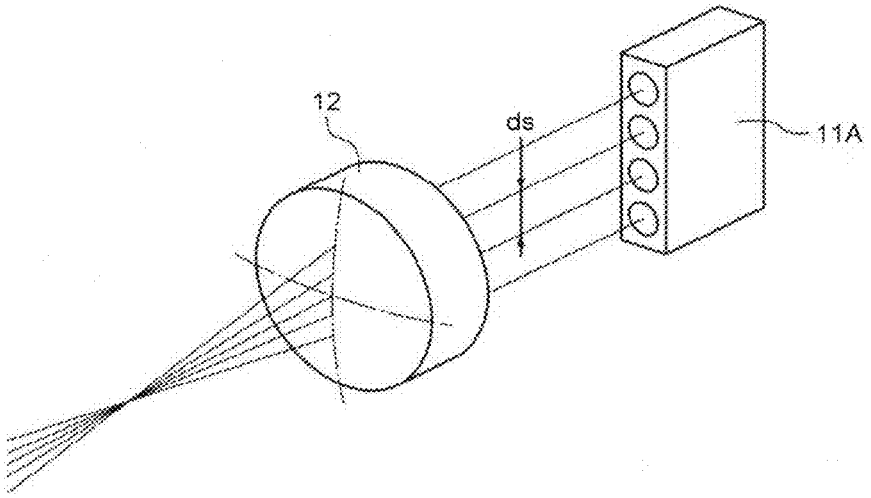
FIG. 5 is a schematic illustrating an exemplary light source in an optical scanning device.

FIG. 5 is a schematic illustrating an exemplary light source in the optical scanning device 1010. In FIG. 5, a light source 11A is a multi-beam light source implemented as a semiconductor laser array consisting of four semiconductor lasers. The light source 11A is positioned perpendicularly to the optical axis of the collimator lens 12.

Figure 6:
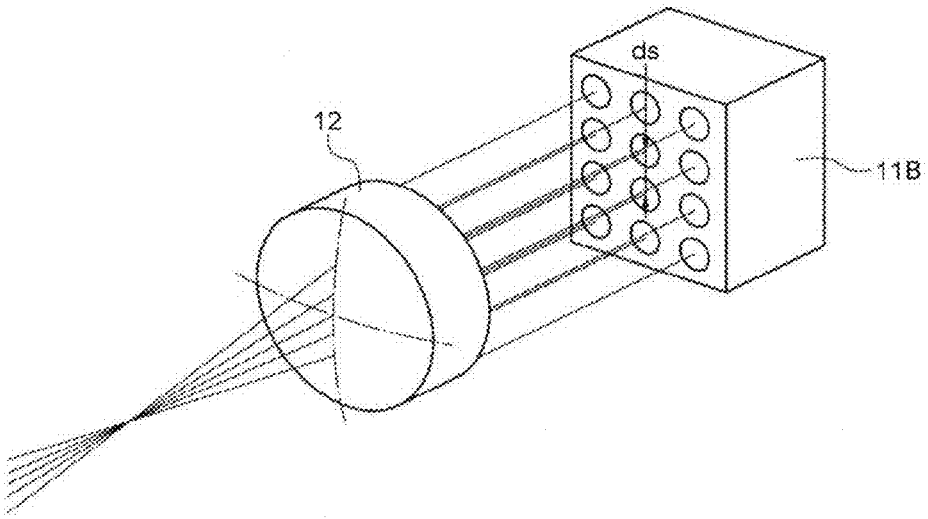
FIG. 6 is a schematic illustrating another exemplary light source in the optical scanning device.

FIG. 6 is a schematic illustrating another exemplary light source in the optical scanning device 1010. In FIG. 6, a light source 11B is a vertical cavity surface emitting laser (VCSEL) of which wavelength is 780 nanometers and of which light-emitting points are positioned on a plane including the Y-axial and Z-axial directions.

The light source 11B has three light-emitting points in the horizontal direction (main-scanning direction, Y-axial direction) and four light-emitting elements in the vertical direction (sub-scanning direction, Z-axial direction), resulting in twelve in total, as an example.

When the light source 11B is used in the optical scanning device 1010, four scan lines in the vertical direction can be scanned simultaneously by scanning one scan line with three light-emitting points that are horizontally provided per scan line.

In the embodiment, the "interval between the light-emitting elements" represents a distance between the centers of two light-emitting elements.

Referring back to FIG. 4, the collimator lens 12 is positioned on the optical path of the light output from the light source 11, and controls to collimate the light into parallel rays or approximately parallel rays.

The cylindrical lens 13 converges the light passed through the collimator lens 12 at a point near the deflecting reflective surface of the polygon mirror 15 only in the Z-axial direction (sub-scanning direction).

The cylindrical lens 13 forms an image of the light output from the light source 11 near the reflecting surface of the folding mirror 14, as a line image extending in the main-scanning direction (Y-axial direction).

The folding mirror 14 folds the light the image of which is formed by the cylindrical lens 13 to the polygon mirror 15.

The optical system positioned on the optical path between the light source 11 and the polygon mirror 15 is also referred to as a pre-deflector optical system.

The polygon mirror 15 is a polygon mirror rotating about a rotating shaft perpendicularly intersecting with the longitudinal direction (rotating shaft direction) of the photosensitive element 1030. Each of the mirror surfaces of the polygon mirror 15 severs as a deflecting reflective surface.

The polygon mirror 15 is caused to be rotated by a motor at a desired constant speed by causing a driving integrated circuit (IC) not illustrated to feed an appropriate clock to the motor unit.

When the polygon mirror 15 is rotated by the motor unit at a constant speed in the direction of the arrow, each of the light beams reflected on the deflecting reflective surface is deflected as a deflected beam with a constant angular velocity.

The first scanning lens 21, the second scanning lens 22, the folding mirror 24, and the synchronization detection sensor 26 make up a scanning optical system. The scanning optical system is positioned on the optical path of the light deflected on the polygon mirror 15.

The first scanning lens 21 is positioned on the optical path of the light deflected on the polygon mirror 15.

The second scanning lens 22 is positioned on the optical path of the light passed through the first scanning lens 21.

The folding mirror 24 is a long flat mirror, and folds the optical path of the light passed through the second scanning lens 22 toward the photosensitive element 1030.

In other words, the light deflected on the polygon mirror 15 passes through the first scanning lens 21 and the second scanning lens 22, and the photosensitive element 1030 is irradiated with the light, so that light spots are formed on the surface of the photosensitive element 1030.

The light spots on the surface of the photosensitive element 1030 are carried in the longitudinal direction of the photosensitive element 1030 as the polygon mirror 15 is rotated. The direction in which the light spots on the surface of the photosensitive element 1030 move (Y-axial direction) represents the "main-scanning direction", and the rotating direction of the photosensitive element 1030 (Z-axial direction) represents the "sub-scanning direction".

The synchronization detection sensor 26 receives the light from the polygon mirror 15, and outputs a signal corresponding to the amount of received light (photoelectric conversion signal) to the scanning control device. The signal output from the synchronization detection sensor 26 is also referred to as a "synchronization detection signal".

As illustrated in FIG. 4, in the optical scanning device 1010, a plurality of lines on the scanned surface of the photosensitive element 1030 are simultaneously scanned by the scanning via one deflecting reflective surface of the polygon mirror 15. A piece of print data for one line corresponding to one light-emitting point is stored in a buffer memory in the image processor for controlling the light-emitting signals for the respective light-emitting points.

The print data is read for each of the deflecting reflective surfaces of the polygon mirror 15. The light beams are turned ON or OFF based on the print data across a scan line on the latent image carrier, so that an electrostatic latent image is formed by the scan line.

Figure 7:
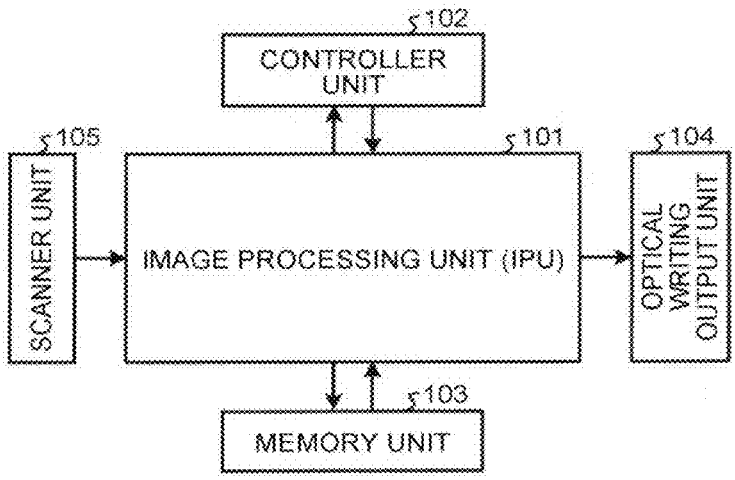
FIG. 7 is a block diagram illustrating an image processor in the image forming apparatus.

FIG. 7 is a block diagram illustrating the image processor in the image forming apparatus. As illustrated in FIG. 7, the image processor includes an image processing unit (IPU) 101, a controller unit 102, a memory unit 103, an optical writing output unit 104, and a scanner unit 105.

After performing rotation, repetition, aggregation, and decompression, the controller unit 102 performs output to the IPU again.

A lookup table for storing therein various types of data is prepared in the memory unit 103.

The optical writing output unit 104 causes a control driver to modulate the light source 11 based on ON data, thereby forming an electrostatic latent image on the photosensitive element 1030. The optical writing output unit 104 forms an image on a recording sheet based on an input signal received from a gradation processing unit described later.

The scanner unit 105 reads an image, and generates image data such as red-green-blue (RGB) data based on the image.

Figure 8:
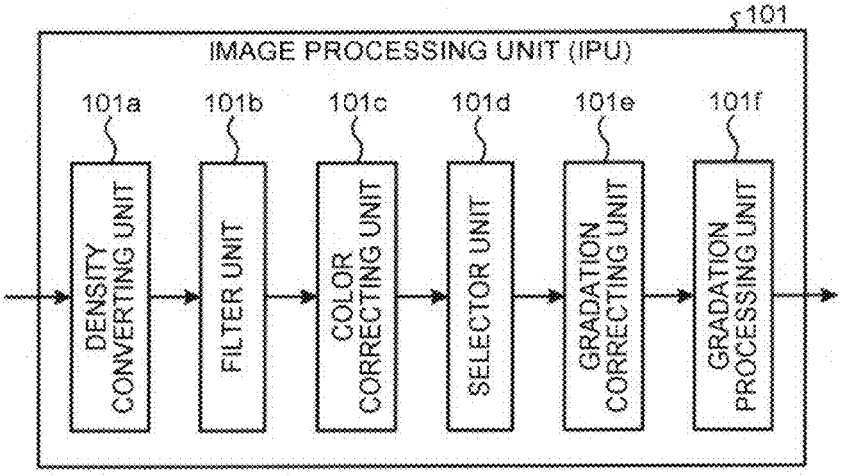
FIG. 8 is a block diagram illustrating an image processing unit in the image processor.

FIG. 8 is a block diagram illustrating the image processing unit 101 in the image processor. As illustrated in FIG. 8, the image processing unit 101 includes a density converting unit 101*a*, a filter unit 101*b*, a color correcting unit 101*c*, a selector unit 101*d*, a gradation correcting unit 101*e*, and a gradation processing unit 101*f*.

The density converting unit 101*a* converts the RGB image data received from the scanner unit 105 into density data using the lookup table, and outputs the density data to the filter unit 101*b*.

The filter unit 101*b* performs image correcting processing such as smoothing and edge enhancement to the density data received from the density converting unit 101*a*, and outputs the corrected data to the color correcting unit 101*c*.

The color correcting unit 101*c* performs a color correction (masking) process.

The selector unit 101*d* selects one of C, M, Y, and K for the image data received from the color correcting unit 101*c*, and outputs the selected one to the gradation correcting unit 101*e* under the control of the image processing unit 101.

The gradation correcting unit 101*e* stores data in advance for C, M, Y, and K data received from the selector unit 101*d*. The gradation correcting unit 101*e* is specified with a γ curve allowing linear characteristics to be acquired for a piece of input data.

The gradation processing unit 101*f* performs gradation processes such as dithering to the image data received from the gradation correcting unit 101*e*, and outputs the signal to the optical writing output unit 104.

Image Forming Method (1)

The following describes some approaches to the exposure in the image forming method according to the embodiment.

Figure 9:
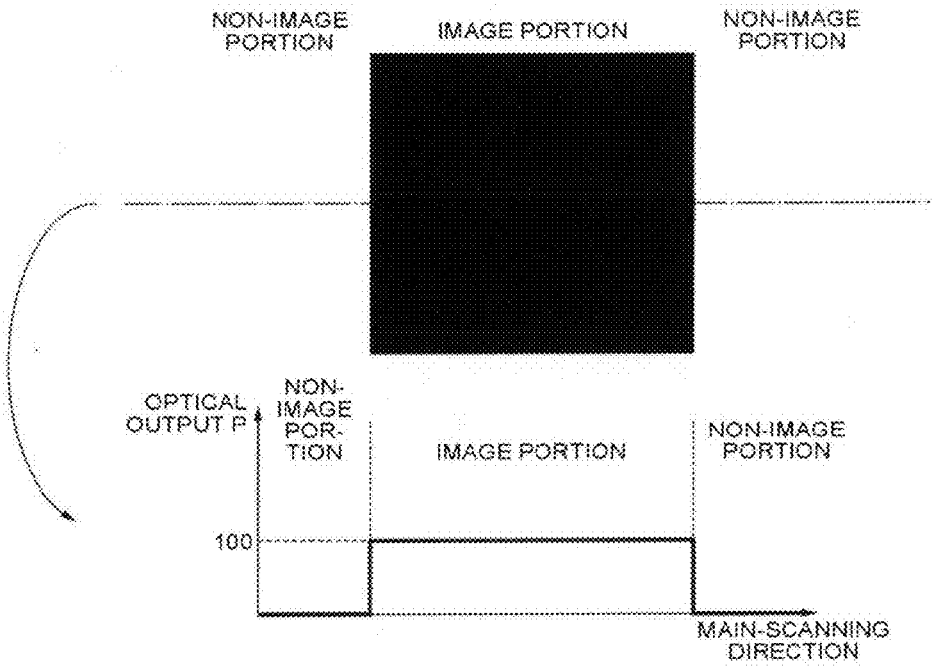
FIG. 9 is a schematic illustrating an image portion and an optical output waveform in a reference example.

FIG. 9 is a schematic illustrating an image portion and an optical output waveform in a reference example. As illustrated in FIG. 9, in the image forming method according to the reference example, an optical output waveform for forming a latent image is such a waveform that the photosensitive element is exposed with an optical output value required to achieve a target image density on an image portion including a line image or a solid image, over a prescribed time period.

The image portion is a portion of an image pattern consisting of a plurality of pixels, and for which an image is to be formed by attaching toner. A non-image portion is a portion of the image pattern for which no image is to be formed and on which no toner is attached.

In the explanation hereunder, an image density to be achieved will be referred to as a "target image density". In the explanation hereunder, a prescribed optical output value required to achieve the target image density is referred to as a "target exposure optical output value". In the explanation hereunder, a prescribed time period over which the entire pixels in the image portion are exposed with the target exposure optical output value to achieve the target image density is achieved referred to as a "target exposure time". In the explanation hereunder, the exposure with the target exposure optical output value over the target exposure time is referred to as a "standard exposure".

In the embodiment, solid images are image portions of which area is larger than line images.

Figure 10:
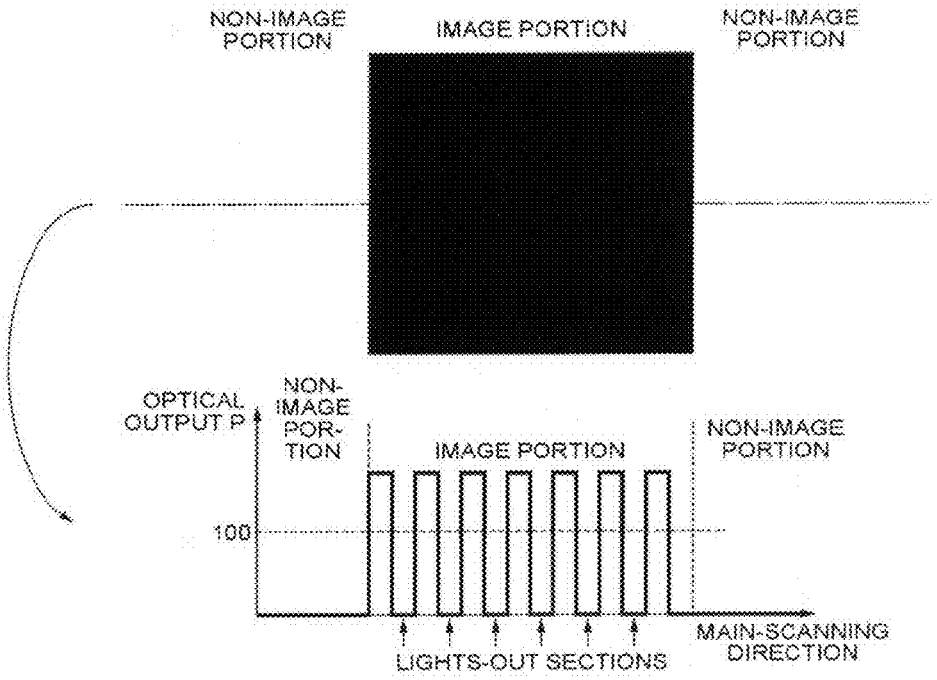
FIG. 10 is a schematic illustrating an image portion and an optical output waveform in the embodiment.

FIG. 10 is a schematic illustrating an image portion and an optical output waveform in the embodiment. As illustrated in FIG. 10, in the embodiment, to achieve the target image density in image portions including a line image and a solid image, a waveform used to form a latent image is a waveform causing the photosensitive element to be exposed with an optical output values higher than the target exposure optical output value over an exposure time that is shorter than the target exposure time.

In the embodiment, an optical output waveform used in forming a latent image has intermittent lights-out sections across the image portion. In other words, in this embodiment, the waveform is output as pulses in the image portion.

In the explanation hereunder, exposure of the photosensitive element with an optical output value (first optical output value) higher than the target exposure optical output value over an exposure time that is shorter than the target exposure time is referred to as a "concentrated exposure".

In the concentrated exposure according to this embodiment, when the dot density is 1200 dpi, for example, the optical output value is set to 200 percent of the target exposure optical output value for every pixel in the image portion, and the exposure time is determined by 50 percent of the duty ratio for the target exposure time. For the time of the remaining 50 percent of the duty ratio, the light source is turned off in the image portion.

In the concentrated exposure according to the embodiment, when the dot density is 2400 dpi, as another specific example, the optical output value is set to 200 percent of the target exposure optical output value for one of two adjacent pixels, and the exposure time is set equal to the target exposure time in the image portion. In this case, the remaining pixels are not exposed. This setting is a substantially equivalent of exposing with an optical output value of 200 percent of the target exposure optical output value over a time period corresponding to a 50-percent duty ratio of the target exposure time when the dot density is 1200 dpi.

Figure 11:
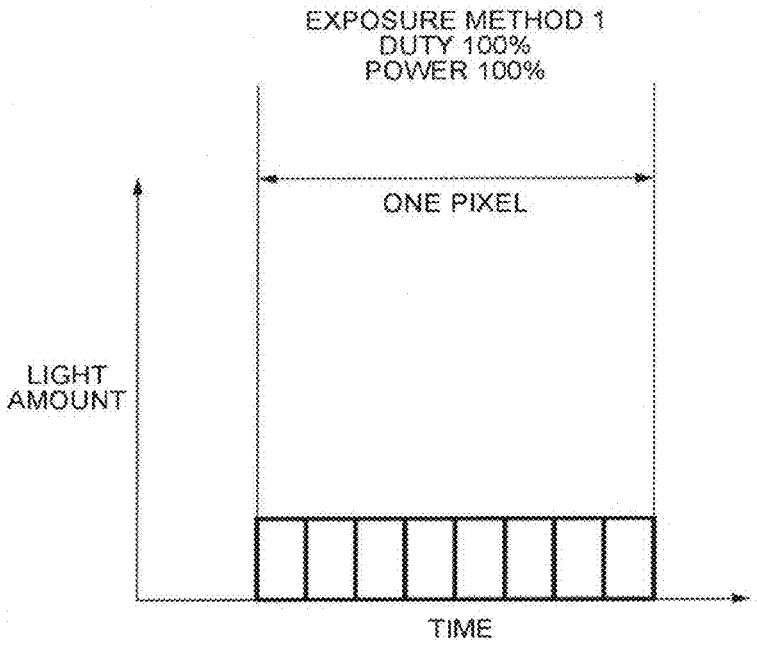
FIG. 11 is a schematic illustrating an exposure method in the reference example.

FIG. 11 is a schematic illustrating the exposure method in the reference example. As illustrated in FIG. 11, the standard exposure in the reference example (hereinafter, referred to as an "exposure method 1") uses a waveform in which the one-dot image portion of a line image or a solid image is exposed with the target exposure optical output value over the target exposure time. Here, an optical output value is set to 100 percent, and the target exposure time is set to a duty ratio of 100 percent.

Figure 12:
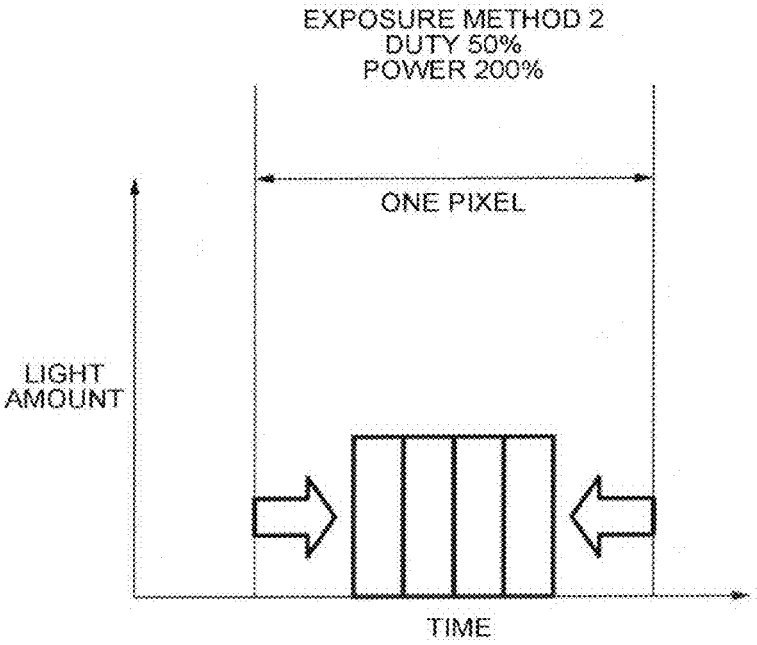
FIG. 12 is a schematic illustrating an exemplary exposure method in the embodiment.

FIG. 12 is a schematic illustrating an exemplary exposure method in the embodiment. As illustrated in FIG. 12, in the concentrated exposure used in the embodiment (hereinafter, referred to as "exposure method 2"), the photosensitive element is exposed with an optical output value of 200 percent of the target exposure optical output value at 50 percent of the duty ratio for the target exposure time. Assuming the width of the image portion is one, the width of the exposed section is four-eighth pixels.

Figure 13:
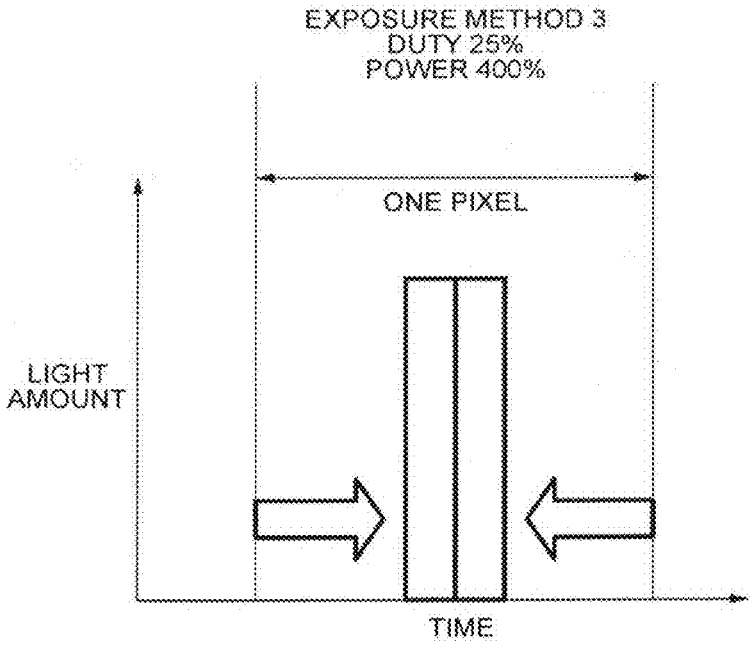
FIG. 13 is a schematic illustrating another exemplary exposure method in the embodiment.

FIG. 13 is a schematic illustrating another exemplary exposure method in the embodiment. As illustrated in FIG. 13, in this other concentrated exposure used in the embodiment (hereinafter, referred to as "exposure method 3"), the photosensitive element is exposed with an optical output value of 400 percent of the target exposure optical output value at 25 percent of the duty ratio for the target exposure time. Assuming the width of the image portion is one, the width of the exposed section is two-eighth pixels.

Figure 14:
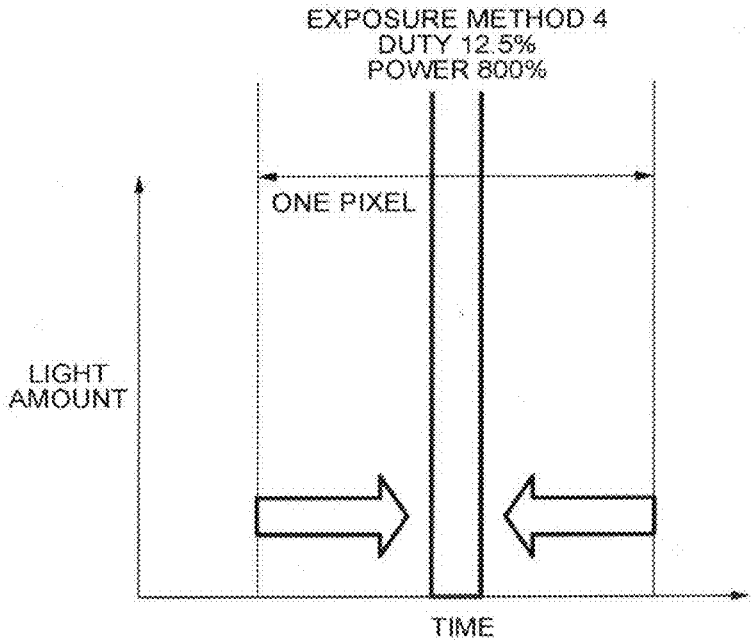
FIG. 14 is a schematic illustrating still another exemplary exposure method in the embodiment.

FIG. 14 is a schematic illustrating still another exemplary exposure method in the embodiment. As illustrated in FIG. 14, in the other concentrated exposure used in the embodiment (hereinafter, referred to as "exposure method 4"), the photosensitive element is exposed with an optical output value of 800 percent of the target exposure optical output value at 12.5 percent of the duty ratio for the target exposure time. Assuming the width of the image portion is one, the width of the exposed section is one-eighth pixels.

The exposure methods 2 to 4 explained above use smaller pulse widths than that in the exposure method 1. In the exposure methods 2 to 4, if the image portion is exposed with the same amount of light as that in the exposure method 1, the resultant latent image will be smaller. The amount of light is therefore controlled with the pulse width so that the integrated amount of light for forming the latent image becomes equal to that in the standard exposure.

In other words, in the exposure methods 2 to 4 using the concentrated exposure, the image portion is exposed with light of high intensity at a smaller pulse width, compared with those in the exposure method 1 in which the standard exposure is used.

In the explanation above, in the exposure methods 2 to 4, the optical output value is set in such a manner that the integrated amount of light remains constant, but the optical output value in the image forming method according to the present invention is not limited to these exposure methods.

In the embodiment, the latent image formation capability is evaluated using an evaluation method described later, under the assumptions that the spot size is 70 micrometers in the main-scanning direction by 90 micrometers in the sub-scanning direction, and the photosensitive element is exposed with the exposure beam at a pulse width smaller than one pixel. Investigated in this embodiment through this evaluation are ways of exposure allowing the latent image resolving power to be improved without changing the spot size of the exposure beam.

Figure 15:
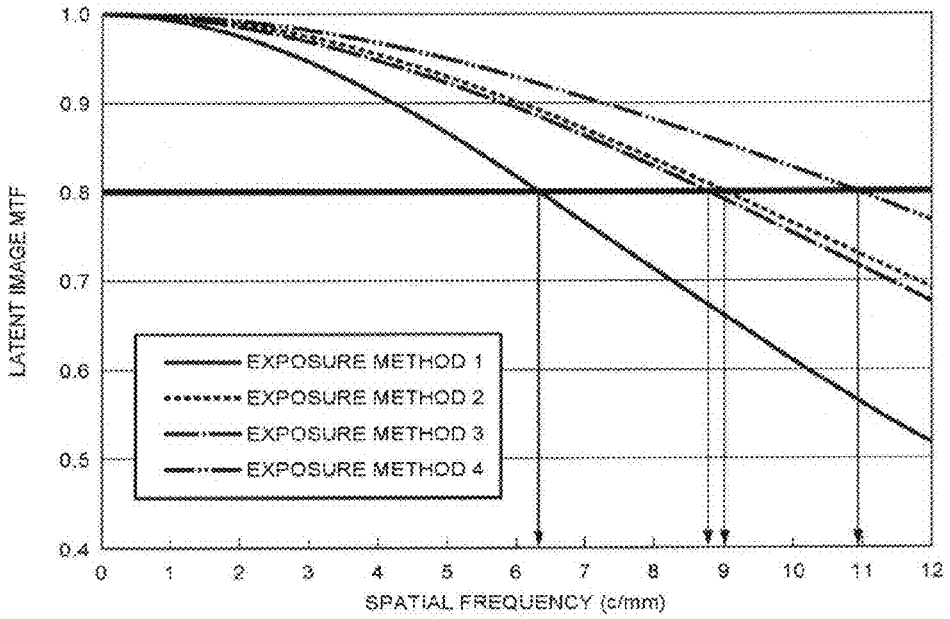
FIG. 15 is a graph indicating spatial frequency characteristics of the different exposure methods.

FIG. 15 is a graph indicating spatial frequency characteristics of the different exposure methods. As illustrated in FIG. 15, the exposure methods 2 to 4 indicate higher modulation transfer function (MTF) up to the high-frequency bandwidth range, compared with the exposure method 1.

According to FIG. 15, the exposure methods 2 to 4 are capable of forming latent images of smaller sizes stably, compared those achieved with the exposure method 1. Among the exposure methods 2 to 4, FIG. 15 indicates that the exposure method 4 using the shortest pulse width is particularly suitable for stable formations of small-sized latent images.

According to FIG. 15, the latent image resolving power is improved in the exposure methods 2 to 4 because the photosensitive element is exposed with a larger amount of light with a shorter pulse width, compared with the exposure method 1. In other words, with the exposure methods 2 to 4 that are used in the image forming method according to the present invention, smaller latent images can be formed stably, compared with the exposure method 1 used in the conventional image forming method.

Figure 16:
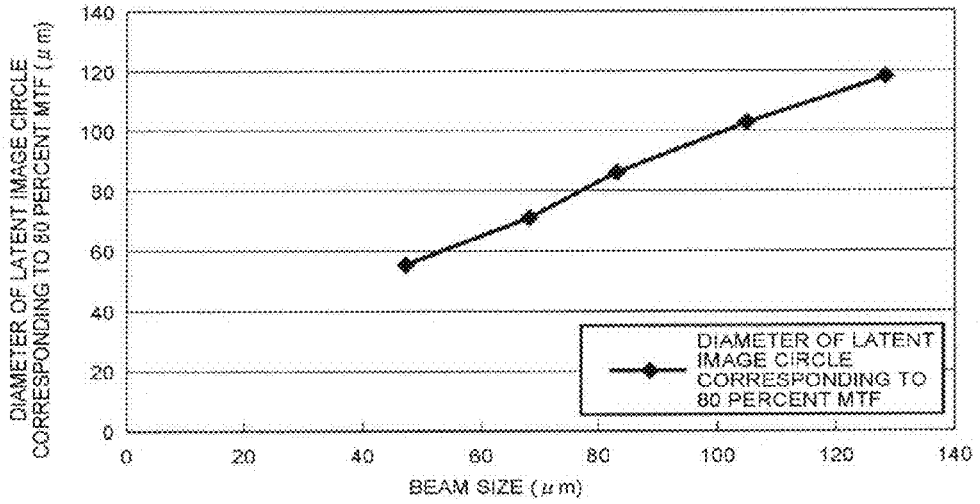
FIG. 16 is a graph indicating a relation between a latent image diameter and a beam spot size.

FIG. 16 is a graph indicating a relation between a latent image diameter and a beam spot size. FIG. 16 indicates a relation between the diameter of a latent image circle corresponding to a latent image MTF of 80 percent, the MTF indicating a latent image dot density, and a beam spot diameter. As indicated in FIG. 16, the latent image resolving power transits almost proportionally to the beam spot size.

In a high-frequency range, that is, when priority is placed on the stability of small-sized latent images, the concentrated exposure method used in the image forming method according to the present invention has an advantage over the conventional exposure method using a smaller beam spot. The optimal beam spot size that is dependent on the output image is determined by the latent image MTF corresponding to the maximum spatial frequency required in the output image.

A characteristic of the concentrated exposure requiring a particular attention is a smaller width of the latent image electric field vector, which means that the resolving power is improved, while the electric field vector in the latent image is increased.

Furthermore, in the image forming method according to the present invention, the integrated amount of light remains the same as that of the target exposure optical output value, unlike when the exposing light source is controlled with phase modulation (PM) or pulse-width modulation (PWM). In the image forming method according to the present invention, the amount of attached toner and the overall image density remain substantially the same as those resulting from the exposure using the target exposure optical output value.

In other words, with the image forming method according to the present invention, the quality of outlined images can be improved without reducing the dot density, while maintaining the image density of the black background.

Furthermore, with the image forming method according to the present invention, a deep latent image electric field can be formed.

Furthermore, with the image forming method according to the present invention, because latent images with a smaller width can be formed, the latent image resolving power can be improved.

Furthermore, with the image forming method according to the present invention, because the integrated amount of light remains constant, the same image density as that from the standard exposure can be achieved.

In the image forming method according to the present invention, the length of each lights-out section (a section not exposed) in an image portion is 10 micrometers or so. In other words, because each lights-out section in an image portion is sufficiently smaller than the beam spot size, the toner can be attached to the entire image portion, considering the spread of the electrical charges in the image portion.

With the image forming method according to the present invention, therefore, high quality solid image can be formed as well.

Furthermore, with the image forming method according to the present invention, the exposure time can be one pixel or less. In other words, with the image forming method according to the present invention, what is called droop, which means the phenomenon in which the optical output fluctuates due to difference in exposure time depending on the image in the conventional exposure method, can be removed.

Image Forming Method (2)

The following describes an exposure method according to another embodiment in the image forming method according to the present invention.

In the conventional exposure method, an image pattern only includes pixels for which an image is to be formed (hereinafter, referred to as an "image pixel") and pixels for which no image is to be formed (hereinafter, referred to as a "non-image pixel").

In the exposure method explained above in the image forming method according to the present invention, however, an image portion includes image pixels that are exposed for image formation, and pixels that do not need to be exposed (hereinafter, referred to as a "not-exposed pixel").

Explained now is an exposure method in which a not-exposed pixel is used as a process adjustment pixel.

A process adjustment pixel herein means a pixel not directly related to an image pattern, and is a pixel having no image information. The process adjustment pixel is used to adjust the image forming process when there is some variation in the image forming process, or when some elements such as a photosensitive element used in image formation become fatigue or degraded.

In the embodiment, therefore, a default condition may be configured not to make any output to the process adjustment pixels in any image patterns. In the embodiment, a default condition may also be configured to make an output to the process adjustment pixels only in a particular image pattern.

The process adjustment pixel is not a pixel only intended for electrical signal processing, but is a pixel that is exposed within the valid area of the photosensitive element, in the same manner as an actual image pattern.

Generally speaking, the height of attached toner, that is, the pile height is not the same on a line image and a solid image. This is because the latent image electric field formed on a line image is generally deeper than that on a solid image.

Due to the user needs for better finish of formed images or demands for reduction in toner consumptions, there is a demand for equalizing the pile heights among the line images and the solid image.

Figure 17:
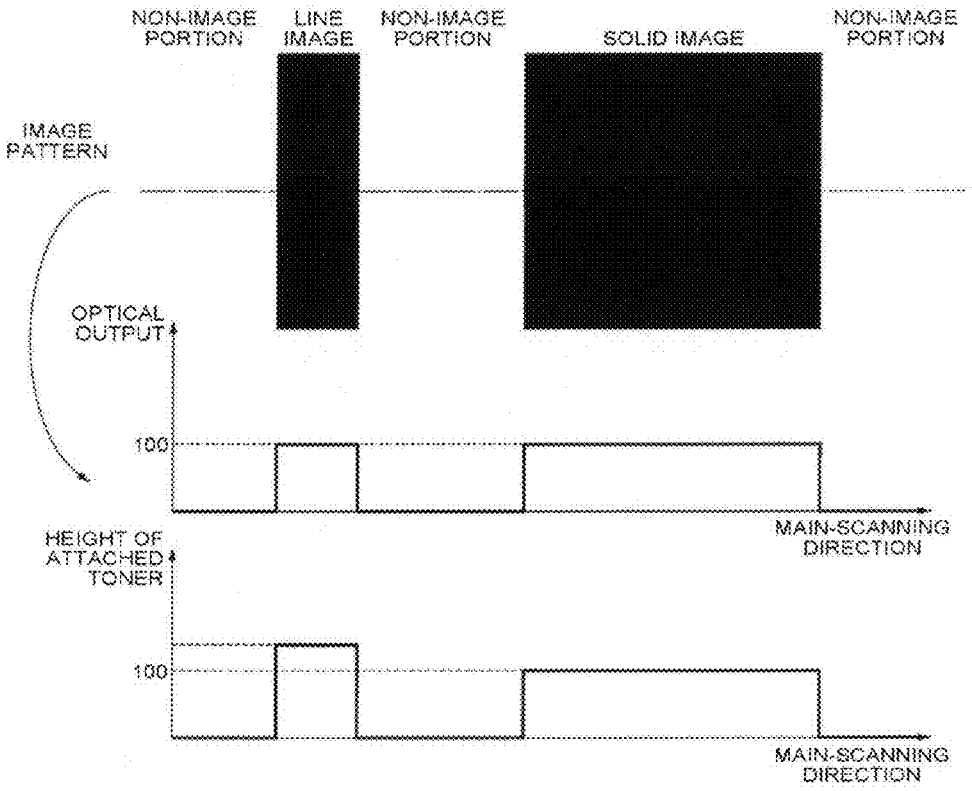
FIG. 17 is a schematic illustrating optical output waveforms and attached toner heights for a line image and a solid image in the reference example.

FIG. 17 is a schematic illustrating optical output waveforms and attached toner heights for a line image and a solid image in the reference example. As illustrated in FIG. 17, when a line image and a solid image are exposed with the same optical output value, the pile height of the line image, which has a stronger latent image electric field, becomes higher by several-ten percent than that on the solid image. The pile height of a line image may be higher by 50 percent or more than that of a solid image.

A known method for reducing the amount of attached toner on the line images is to devise the conditions of the developing process.

In this method, however, the faithfulness of the reproduced line image and solid image to the respective latent images are intentionally broken. It is therefore not easy to adjust the pile heights of a line image and a solid image to the same level in the developing process.

In the embodiment, the process adjustment pixel is used to increase the amount of attached toner on the solid image, instead of reducing the amount of attached toner on the line image.

Figure 18:
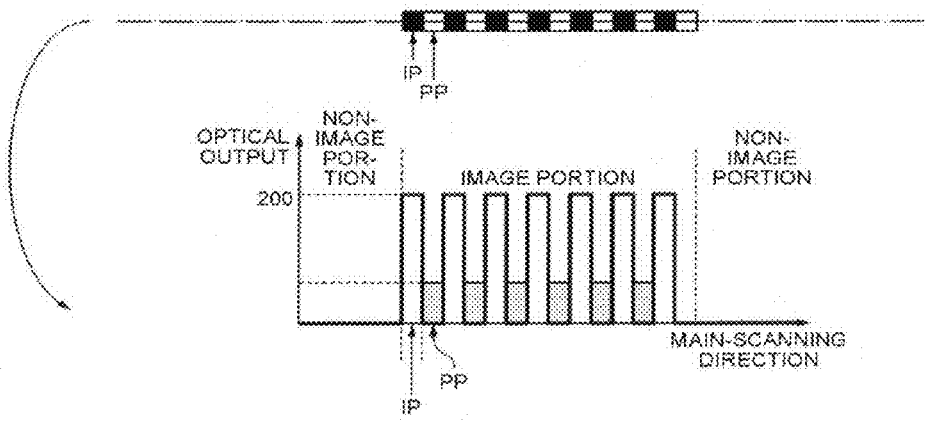
FIG. 18 is a schematic illustrating an image portion including process adjustment pixels and an optical output waveform according to the embodiment.

FIG. 18 is a schematic illustrating an image portion including process adjustment pixels and an optical output waveform according to the embodiment. Illustrated in FIG. 18 are an image portion including process adjustment pixels, and the optical output waveform for the image portion. Image pixels IP and process adjustment pixels PP are arranged alternatingly in the image portion. In this example, the dot density is 2400 dpi.

In the example illustrated in FIG. 18, the process adjustment pixels PP are included in a solid image when the pile height of the line image is higher by 25 percent than that of the solid image.

In the exposure method according to the embodiment, the optical output value is set in such a manner that the amount of attached toner on the line image is adjusted to a desired level, and the optical output value (second optical output value) for the process adjustment pixels PP is set in such a manner that the pile height of the solid image is adjusted to the same pile height of the line image.

Here, the optical output value for the image pixels IP is set to 200 percent of the target exposure optical output value, and the optical output value for the process adjustment pixels PP is set to 50 percent of the target exposure optical output value.

When the image portion is exposed using the exposure method according to the embodiment, the pixel size is 10.6 micrometers with a dot density of 2400 dpi. This pixel size is smaller than the beam spot size of the exposure optical system that is approximately 30 micrometers to 80 micrometers. Therefore, even if the process adjustment pixels PP are not irradiated with the optical output and become not-exposed pixels, the image pixels IP and the not-exposed pixels are blended together to form a solid image in the electrostatic latent image forming process.

When a solid image including the process adjustment pixels PP are exposed using the exposure method according to the embodiment, the output value for the image portion is added with 50-percent, so that the optical output value is summed up to 250 percent of the target exposure optical output value, together with the optical output value for the image pixels IP. When the process adjustment pixels PP are exposed using the exposure method according to the embodiment, the integrated amount of light for the image portion is increased by 25 percent.

Because the amount of attached toner is almost proportional to the integrated amount of light, the exposure method according to the embodiment can increase the pile height of the solid image by 25 percent. With the exposure method according to the embodiment, therefore, the pile height of the line images can be controlled.

In other words, in the exposure method according to the embodiment, the image density or the pile height can be controlled by including the process adjustment pixels in an image portion, between the pixels to be exposed.

Figure 19:
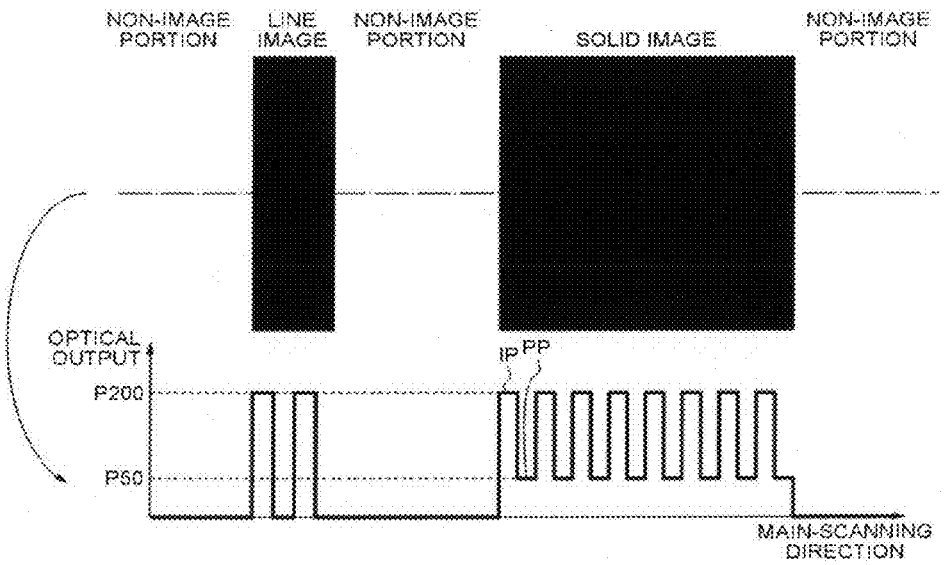
FIG. 19 is a schematic illustrating an example of an image portion including a line image and a solid image and an optical output waveform according to the embodiment.

FIG. 19 is a schematic illustrating an example of an image portion including a line image and a solid image and an optical output waveform according to the embodiment. As illustrated in FIG. 19, in accordance with the exposure method according to the embodiment, the concentrated exposure is performed on a line image with no process adjustment pixels included, and the concentrated exposure is performed on a solid image with some process adjustment pixels PP included.

Illustrated in FIG. 19 is a one-bit image portion of which dot density per one pixel is 2400 dpi (with a pixel size of 10.6 micrometers).

In the solid image, the image pixels IP are concentrated-exposed with an optical output value of 200 percent of the target exposure optical output value, while the process adjustment pixels PP are exposed with an optical output value of 50 percent of the target exposure optical output value, so that the pile height of the solid image is increased by 25 percent (=50/200). The optical outputs for the process adjustment pixels PP are output between those for the image pixels IP in the image portion.

When the optical output value for the entire solid image is increased, the image quality is not affected and only the amount of attached toner is increased.

As explained above, according to the embodiment, such use of the process adjustment pixels PP enables the pile height of line images and solid images to be controlled.

According to the embodiment, a pile height ratio can be adjusted using the process adjustment pixels PP, even when the ratio between the pile height of a line image and the pile height of a solid image changes in some actual usage environment of the image forming apparatus.

In this embodiment, by switching the optical output value in an image portion among three or more values, high-quality image formations can be achieved, although the costs are increased.

Figure 20:
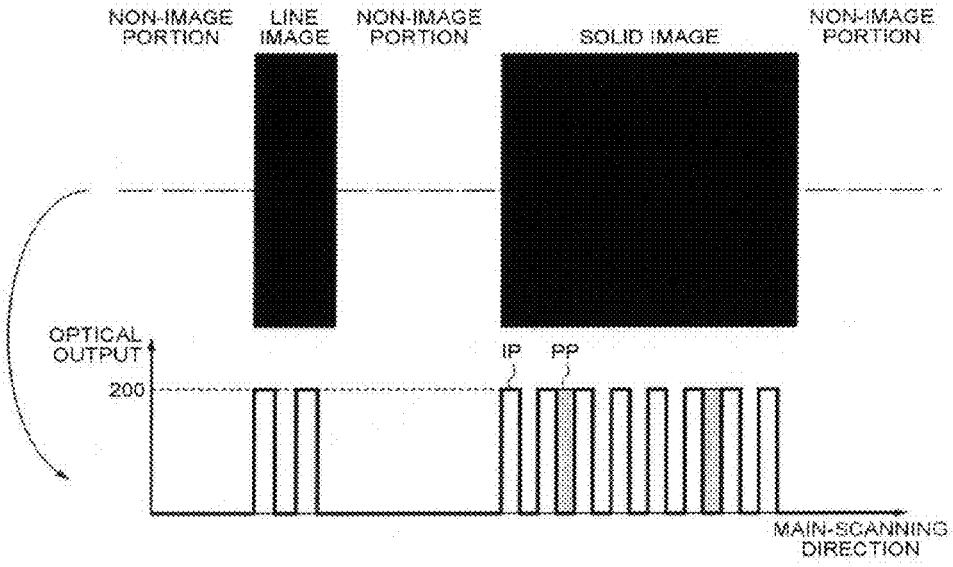
FIG. 20 is a schematic illustrating another example of an image portion including a line image and a solid image and an optical output waveform according to the embodiment.

FIG. 20 is a schematic illustrating another example of an image portion including a line image and a solid image and an optical output waveform according to the embodiment. As illustrated in FIG. 20, the process adjustment pixels may also be irradiated with the same optical output value as that for the image pixels.

The process adjustment pixels PP illustrated in FIG. 19 are irradiated with an optical output value of 50 percent of the target exposure optical output value between optical outputs of each pair of the image pixels IP in the image portion.

By contrast, the process adjustment pixels PP illustrated in FIG. 20 are irradiated with an optical output value of 200 percent of the target exposure optical output value (which is the same value as the optical output value for the image pixels IP), and such an output is made between only some pairs of the image pixels IP included in the image portion.

The integrated amount of light of the optical output value to the process adjustment pixels PP illustrated in FIG. 19 is the same as the integrated amount of light of the optical output value to the process adjustment pixels PP illustrated in FIG. 20. In other words, the pile heights of line images and solid images can also be controlled via the optical output to the process adjustment pixels PP illustrated in FIG. 20.

While the spatial frequency is decreased in the optical output to the process adjustment pixels PP illustrated in FIG. 20, because the amount of decrease is 80 micrometers or so, density unevenness will not occur in the solid images.

In the description above, while the optical output value is set only in the main-scanning direction, such an optical output value may be set in the sub-scanning direction as well. By using four pixels in the main-scanning direction and four pixels in the sub-scanning direction, one optical output value can form images with sixteen gradations.

As explained above, with the exposure method according to the embodiment, the pile height can be controlled by using the process adjustment pixels PP.

The optical output values to the process adjustment pixels PP and the integrated amount of light may be changed considering the quality of images to be formed, and, for example, it is also possible to make no optical output to the process adjustment pixels PP.

FIGS. 21A to 21D are schematics illustrating ratios of an image portion occupied by the process adjustment pixels and the image pixels. Illustrated in FIGS. 21A to 21D are examples of how image pixels and process adjustment pixels are arranged two dimensionally, in the scanning direction and the sub-scanning direction. The image pixels with and without an image are presented in black, and the process adjustment pixels are represented in white.

The process adjustment pixels are pixels with no image information, as mentioned earlier, but are illustrated to be white, for the purpose of convenience, in FIGS. 21A to 21D.

Figure 21:
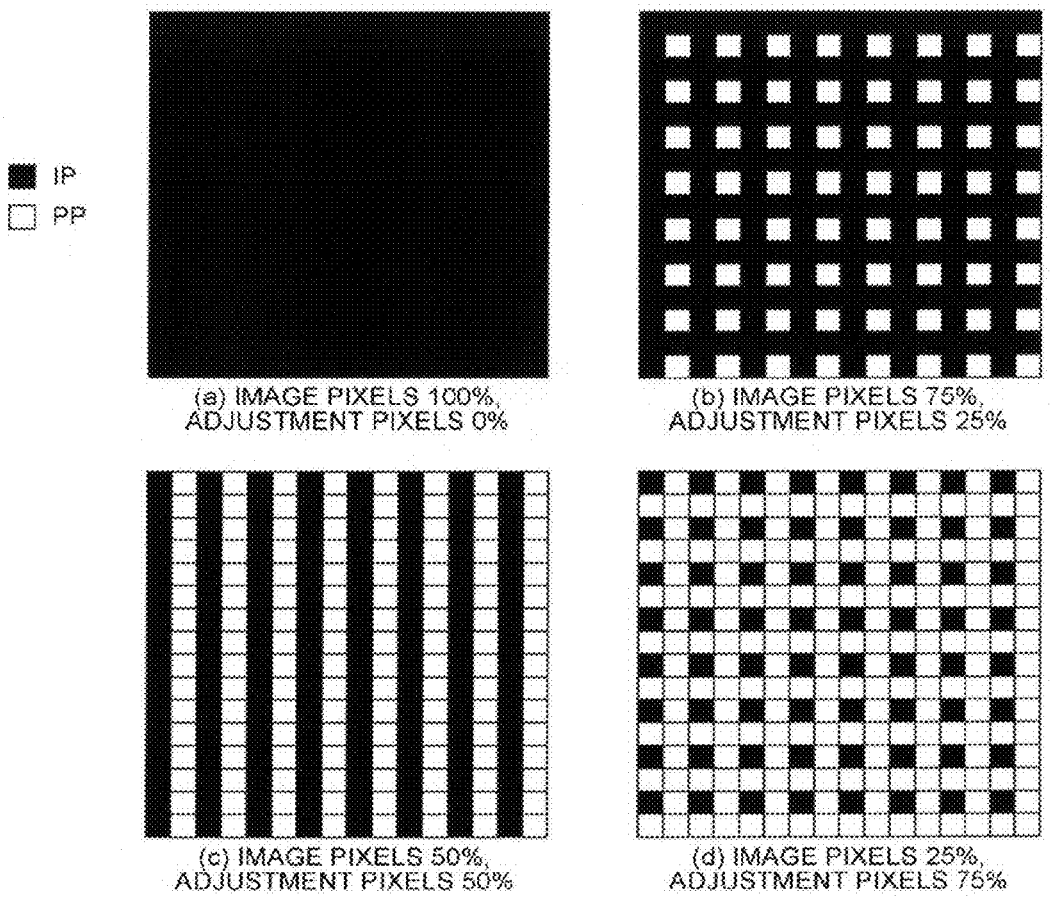
FIGS. 21A to 21D are schematics illustrating ratios of an image portion occupied by the process adjustment pixels and the image pixels.

FIG. 21A provides an example of an image exposed using the standard exposure according to the reference example. The image portion consists only of image pixels, with no process adjustment pixels.

FIG. 21B is an example of another image exposed using the concentrated exposure according to the present embodiment. In the image portion, 75 percent is occupied by the image pixels and 25 percent is occupied by the process adjustment pixels.

FIG. 21C is another example of an image exposed using the concentrated exposure according to the present embodiment. In the image portion, 50 percent is occupied by the image pixels and 50 percent is occupied by the process adjustment pixels.

FIG. 21D is another example of an image exposed using the concentrated exposure according to the present embodiment. In the image portion, 25 percent is occupied by the image pixels and 75 percent is occupied by the process adjustment pixels.

When the ratio of the entire image portion occupied by the process adjustment pixels is 25 percent, as illustrated in FIG. 21B, the optical output value to the image pixels is set to 133 percent of the target exposure optical output value.

When the ratio of the entire image portion occupied by the process adjustment pixels is high, e.g., 75 percent, as illustrated in FIG. 21D, the setting of the optical output value to the image pixels need to be high as well, e.g., 400 percent of the target exposure optical output value.

When the number of elements adjusted using the process adjustment pixel is one, e.g., only the pile height, 25 percent is sufficient as the ratio of the entire image portion occupied by the process adjustment pixels.

By contrast, when the process adjustment pixels occupies a large portion of the image portion, the process adjustment pixels can be used to make various adjustments related to the process conditions, in addition to the pile height.

It is therefore preferable to change the ratio of the entire image portion occupied by the process adjustment depending on the requirements.

Figure 22:
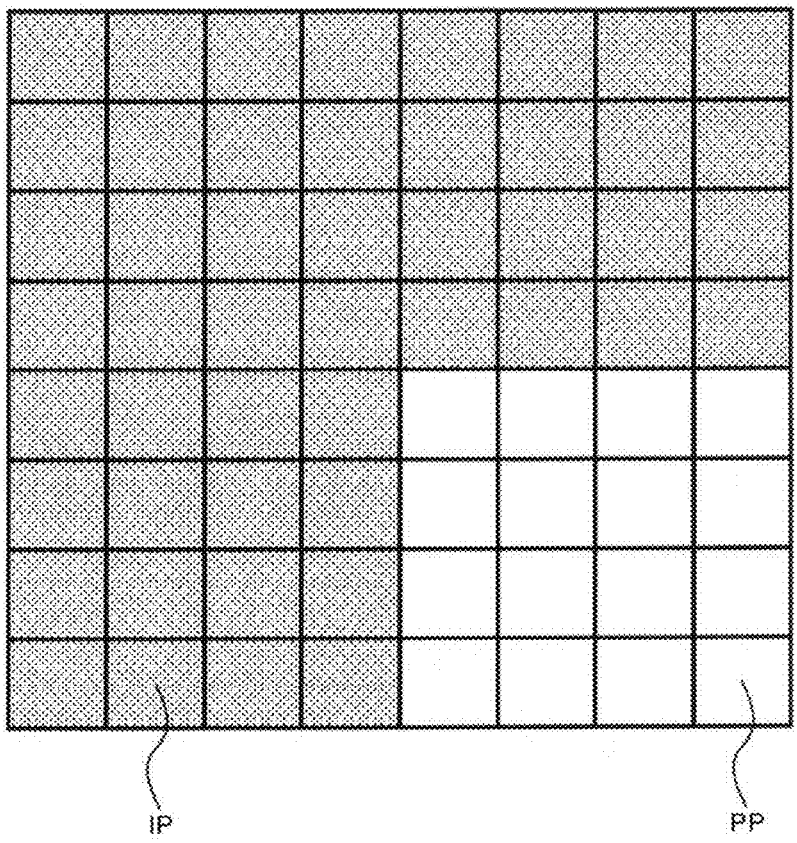
FIG. 22 is a schematic illustrating a pixel according to the reference example.

FIG. 22 is a schematic illustrating a pixel according to the reference example. As illustrated in FIG. 22, an image portion included in an image to be exposed using the exposure method according to the reference example consists only of image pixels IP and non-image pixels NP, without any process adjustment pixels.

Figure 23:
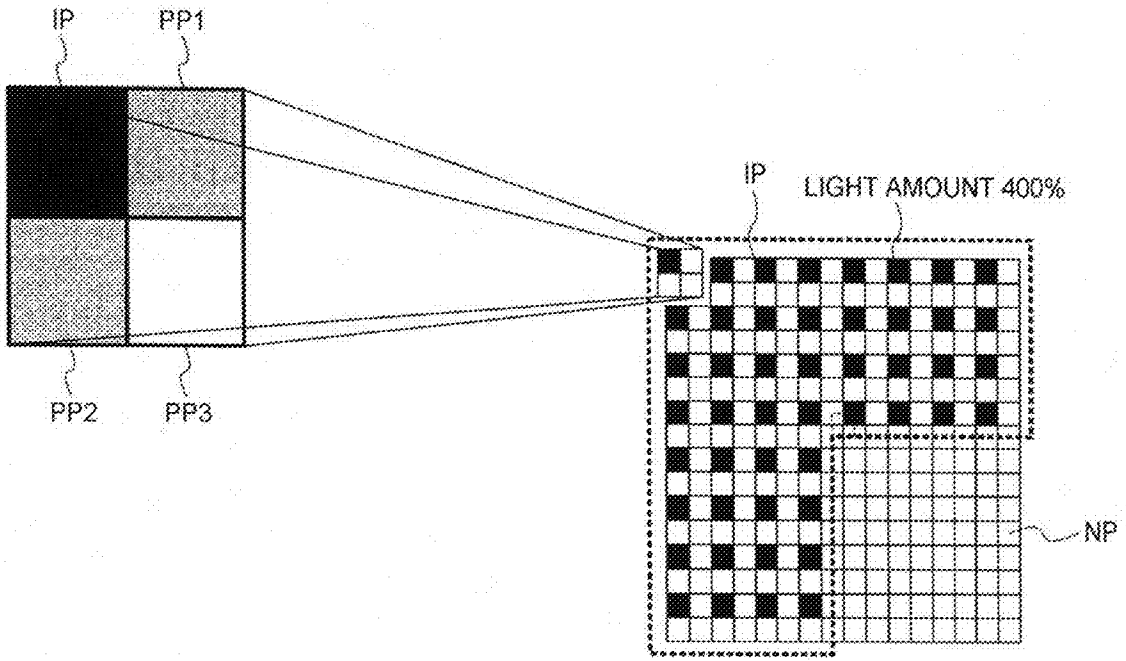
FIG. 23 is a schematic illustrating a pixel according to the embodiment.

FIG. 23 is a schematic illustrating a pixel according to the embodiment. As illustrated in FIG. 23, an image portion included in an image to be exposed using the concentrated exposure according to the embodiment consists of the image pixels IP, the non-image pixel NP, and the process adjustment pixels PP. In the image portion of the image illustrated in FIG. 23, 25 percent is occupied by the image pixels IP and 75 percent is occupied by the process adjustment pixels PP.

In the image exposed according to the embodiment illustrated in FIG. 23, three elements in the image forming process can be adjusted independently using a process adjustment pixel PP1, a process adjustment pixel PP2, and a process adjustment pixel PP3. In this example, the process adjustment pixel PP3 is used to adjust the pile height.

Figure 24:
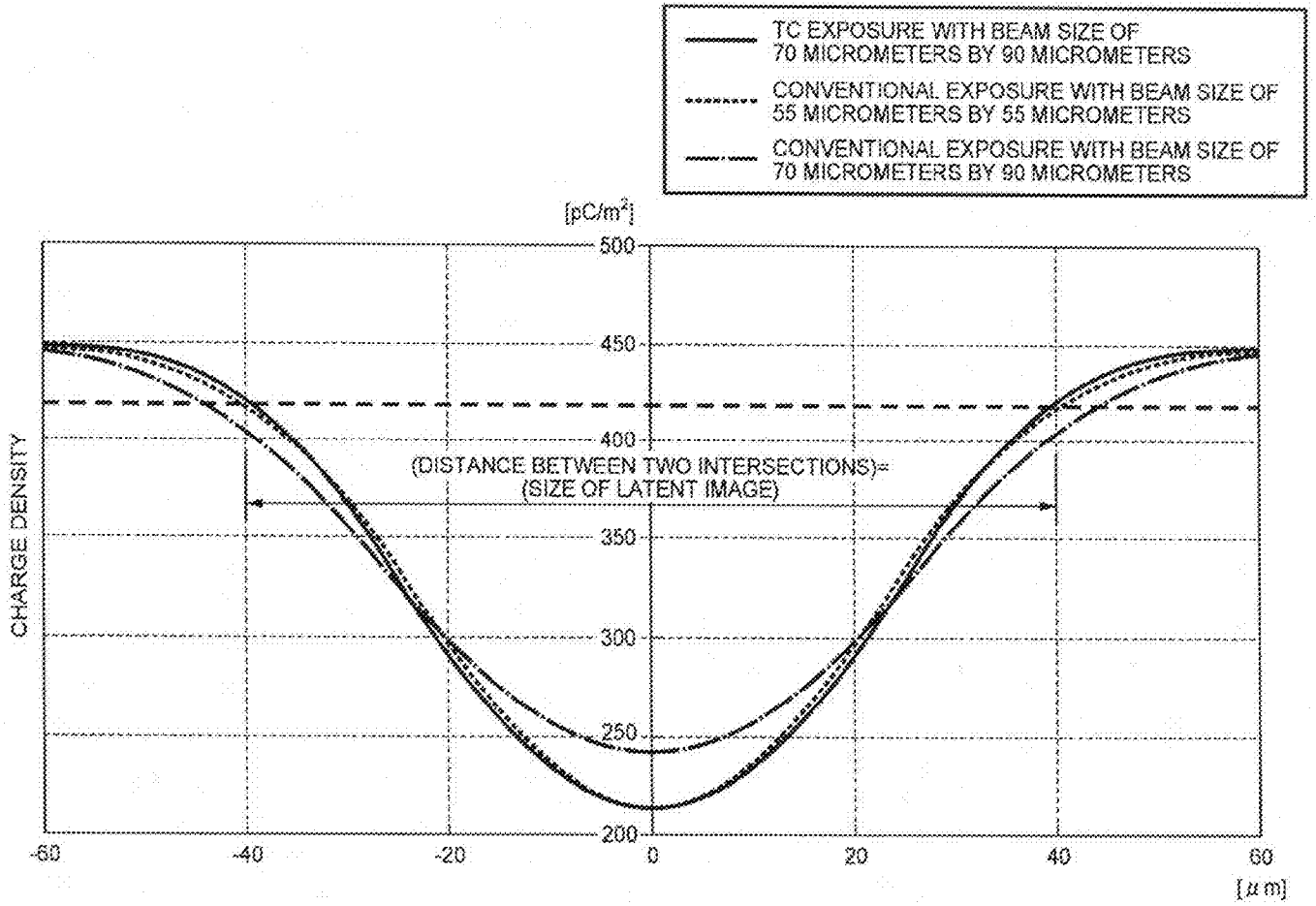
FIG. 24 is a schematic illustrating a latent image diameter formed with the exposure method according to the reference example, and a latent image diameter formed with the exposure method according to the embodiment.

FIG. 24 is a schematic illustrating a latent image diameter formed with the exposure method according to the reference example, and a latent image diameter formed with the exposure method according to the embodiment. FIG. 24 illustrates a simulation result of charge distributions of two-dot latent images when the dot density is 1200 dpi, the latent images formed with the standard exposure according to reference example and with the concentrated exposure according to the embodiment. In the concentrated exposure, the optical output value for the image pixels was set to 400 percent of the target exposure optical output value.

The latent image charge distribution illustrated in FIG. 24 indicates that the latent image diameter achieved by the concentrated exposure with a beam spot size of 70 micrometers by 90 micrometers is equivalent to that achieved by the standard exposure with a beam spot size of 55 micrometers by 55 micrometers. In other words, according to the embodiment, the advantageous effects achieved with the standard exposure using a smaller beam spot size can be achieved with the concentrated exposure.

As explained above, with the exposure method according to the embodiment, image patterns are formed by using some pixels in the image portion as image pixels for forming the image, and concentrated-exposing the image pixels. In this manner, with the exposure method according to the embodiment, the resolving power can be improved while maintaining the image density.

Furthermore, according to the embodiment, adjustments or control of the image forming process such as the adjustment of the pile height can be achieved by using the pixels not used as the image pixels in the image portion as the process adjustment pixels.

Image Forming Method (3)

The following describes, as another embodiment of the image forming method according to the present invention, a process of improving the reproducibility of very small characters.

Character images with a dot density of 1200 dpi (2 points, 3 points, outlined characters) are used in ruby, in floor plans, and the like, and legibility is required in such images. The inventors have uncovered that a cause of deteriorations of such very small characters is in their latent images, not in the developing process or the processes thereafter.

As described earlier, in the image forming method according to the present invention, the optical output waveform is controlled with the PM modulation and the PWM modulation, and the photosensitive element is exposed with an optical output value higher than the target exposure optical output value with a shorter pulse width (concentrated exposure). In this manner, with the image forming method according to the present invention, the latent image resolving power can be improved without changing the beam spot size.

Explained now in this embodiment is a process of improving the image quality of very small outlined characters by improving their latent images, using the concentrated exposure technology in the image forming method according to the present invention.

In this embodiment, a process is performed focusing on the number of black dots adjacent to each white dot.

A black dot adjacent to a white dot means a black dot adjacent to the white dot on any one of +a side, −a side, +b side, and −b side.

Figure 25:
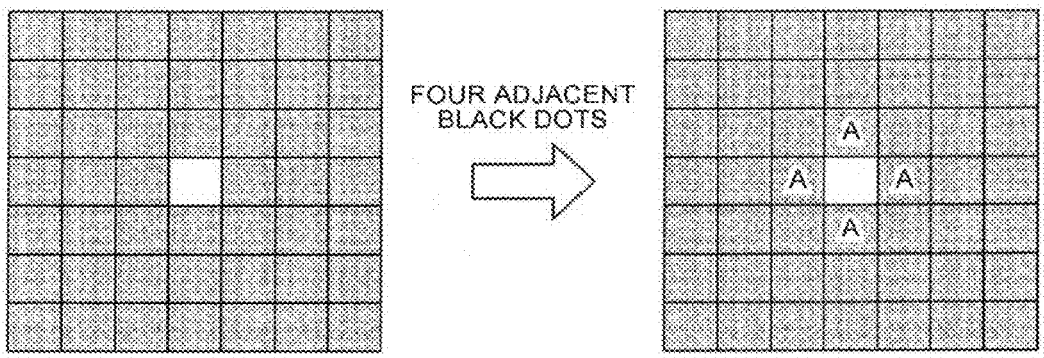
FIG. 25 is a schematic illustrating an example of an image including black dots adjacent to a white dot.

FIG. 25 is a schematic illustrating an example of an image including black dots adjacent to a white dot.

In the embodiment, for example, when the number of black dots adjacent to the white dot is four, as illustrated in FIG. 25, a flag A is set to the black dots adjacent to the white dot.

Figure 26:
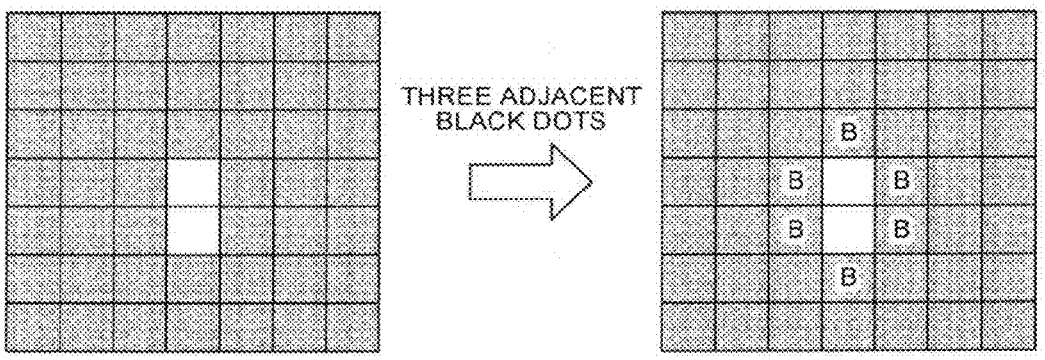
FIG. 26 is a schematic illustrating an image including black dots adjacent to a white dot, with flags set to the black dots.

FIG. 26 is a schematic illustrating another example of an image including black dots adjacent to a white dot.

In the embodiment, for example, when the number of black dots adjacent to the white dot is three, as illustrated in FIG. 26, a flag B is set to the black dots adjacent to the white dot.

Figure 27:
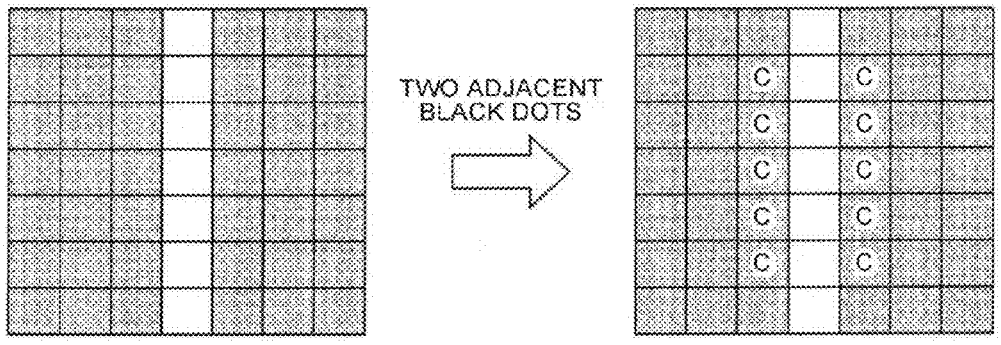
FIG. 27 is a schematic illustrating another example of an image including black dots adjacent to a white dot.

FIG. 27 is a schematic illustrating still another example of an image including black dots adjacent to a white dot.

In the embodiment, for example, when the number of black dots adjacent to the white dot is two, as illustrated in FIG. 27, a flag C is set to the black dots adjacent to the white dot.

In FIG. 27, because the number of adjacent black dots cannot be determined for the white dots at the edges, such dots are disregarded herein.

Figure 28:
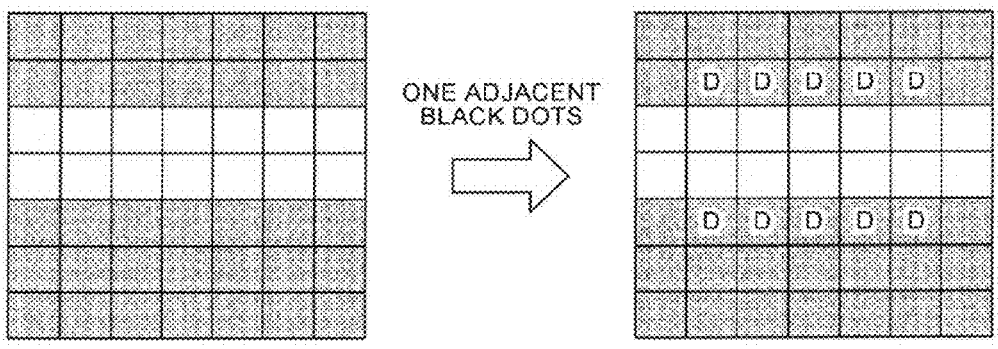
FIG. 28 is a schematic illustrating another example of an image including black dots adjacent to a white dot, with flags set to the black dots.

FIG. 28 is a schematic illustrating another example of an image including black dots adjacent to a white dot.

In the embodiment, for example, when the number of black dots adjacent to the white dot is one, as illustrated in FIG. 28, a flag D is set to the black dots adjacent to the white dot.

Figure 29:
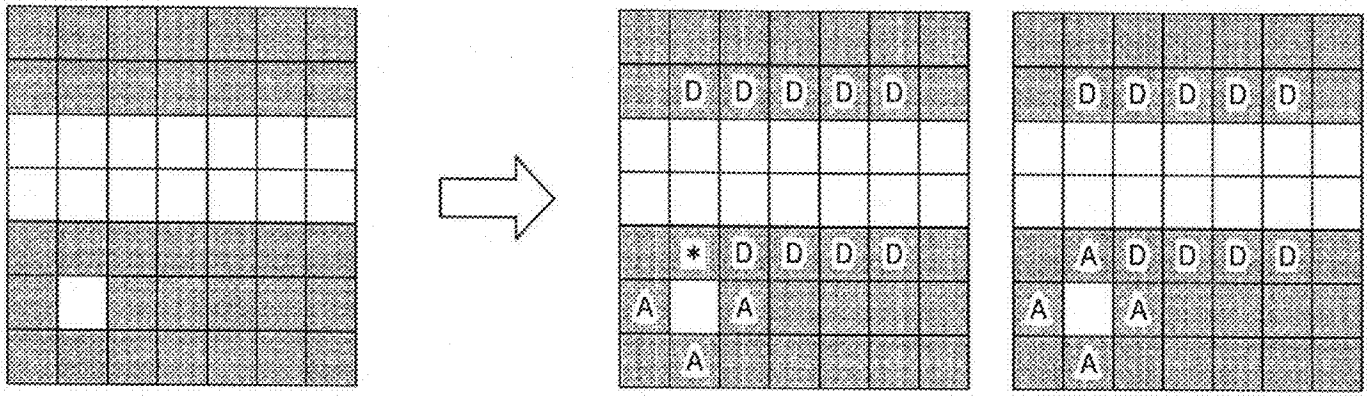
FIG. 29 is a schematic illustrating still another example of an image including black dots adjacent to a white dot.

FIG. 29 is a schematic illustrating still another example of an image including black dots adjacent to a white dot.

In the embodiment, when one black dot is adjacent to two white dots, as illustrated in FIG. 29, the flag D would be set to the black dot focusing on one of the white dots, and the flag A would be set focusing on the other white dot.

As indicated by the dot * in FIG. 29, when different flags are possible for one dot, the white dot with a larger number of adjacent black dots is prioritized, so that the flag A is set to the adjacent black dot.

Figure 30:
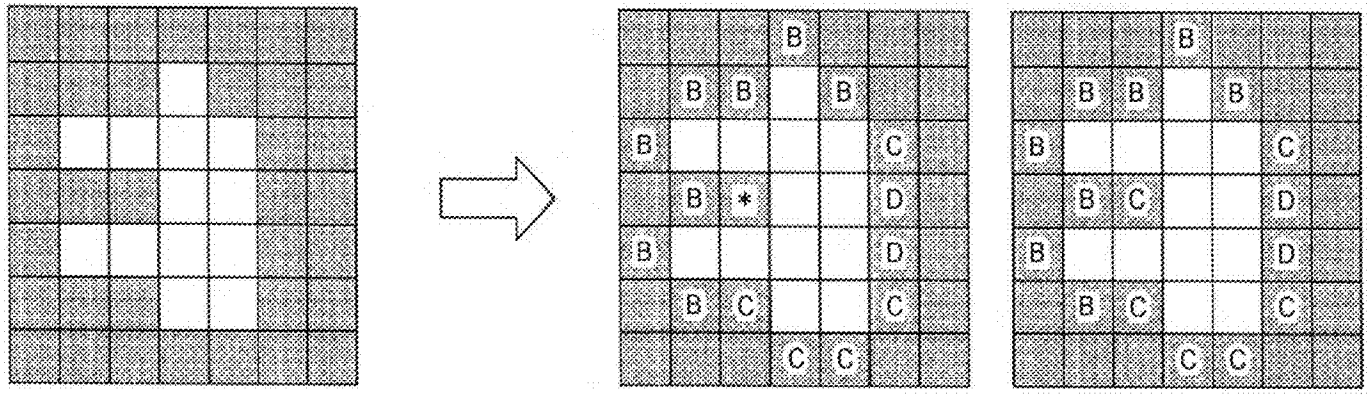
FIG. 30 is a schematic illustrating still another example of an image including black dots adjacent to a white dot.

FIG. 30 is a schematic illustrating another example of an image including black dots adjacent to a white dot.

One black dot may be adjacent to three white dots, as illustrated in FIG. 30. In such a case in which the flag C or the flag D can be set to the adjacent black dot, the white dot with a larger number of adjacent black dots is prioritized, so that the flag C is set to the adjacent black dot.

As explained above, in the process of improving the reproducibility of very small characters according to the embodiment, focusing on the black dots adjacent to a white dot, the number of black dots adjacent to the white dot is counted, and the largest one of the counts (hereinafter, referred to as a "BM value") is calculated.

Figure 31:
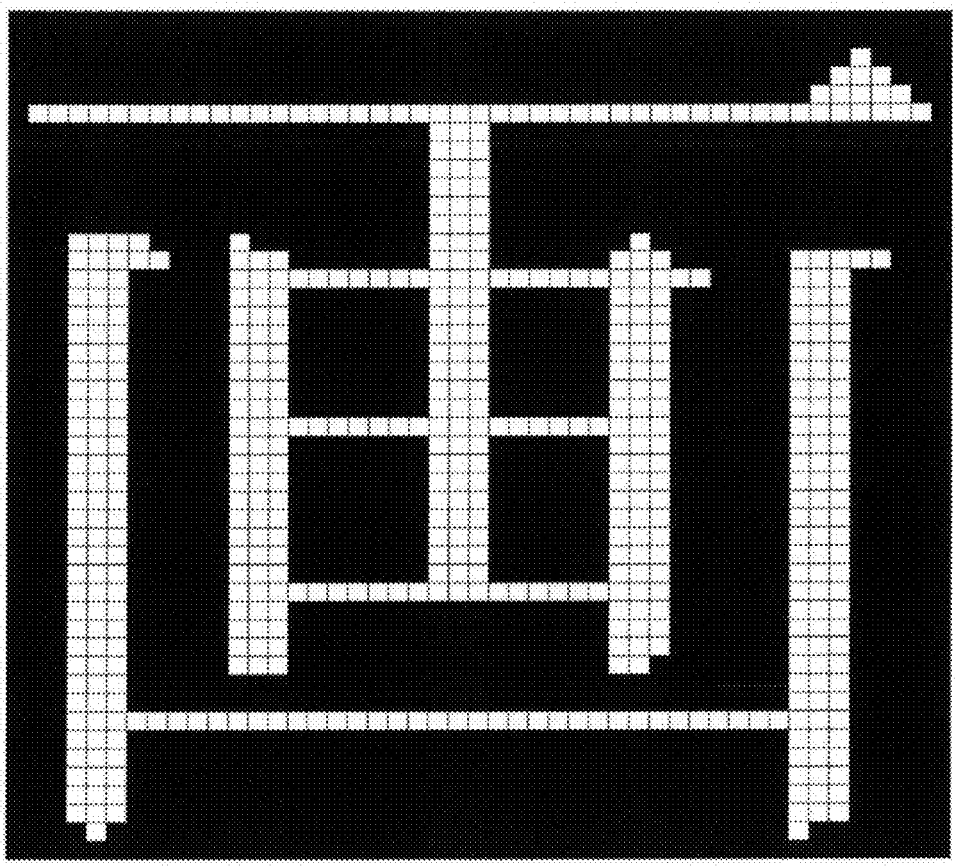
FIG. 31 is a schematic illustrating an example of the image data of an outlined image.

FIG. 31 is a schematic illustrating an example of the image data of an outlined image. In FIG. 31, the outlined image of the character "画" is provided, as an example of outlined image data.

Figure 32:
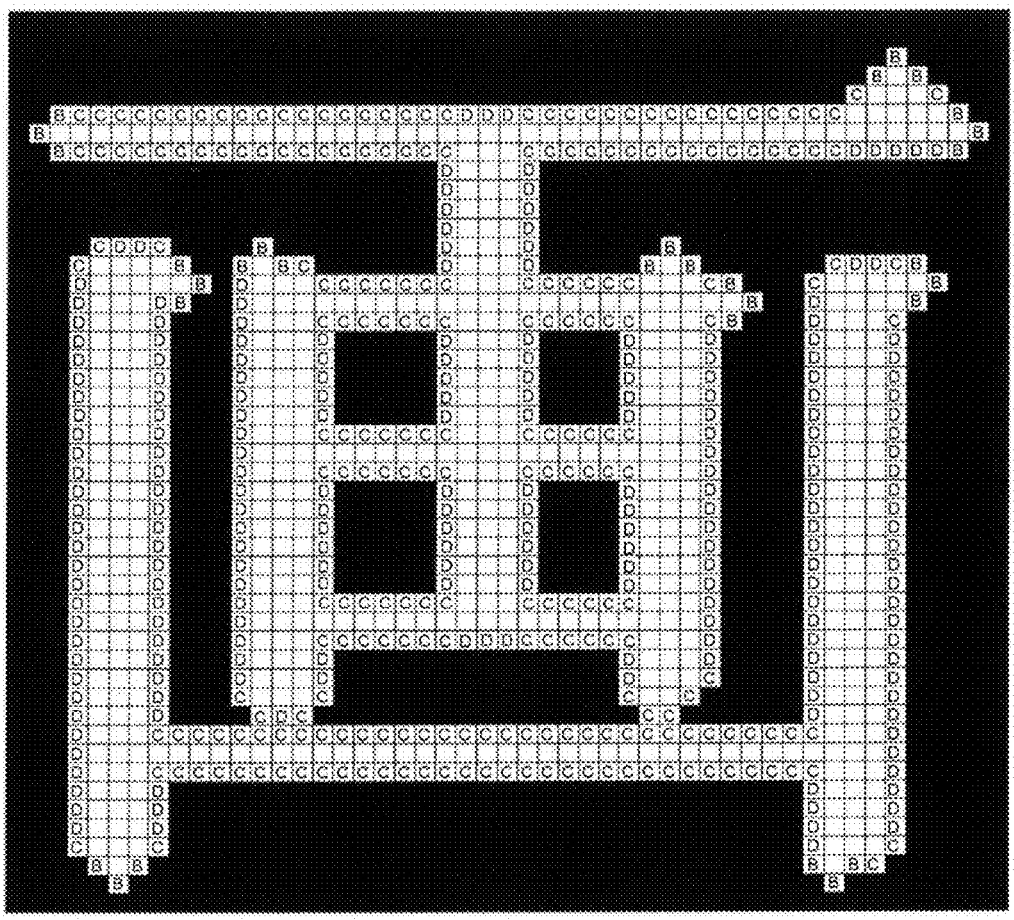
FIG. 32 is a schematic illustrating the result of performing an operation to the exemplary image data of the outlined image.
Figure 33:
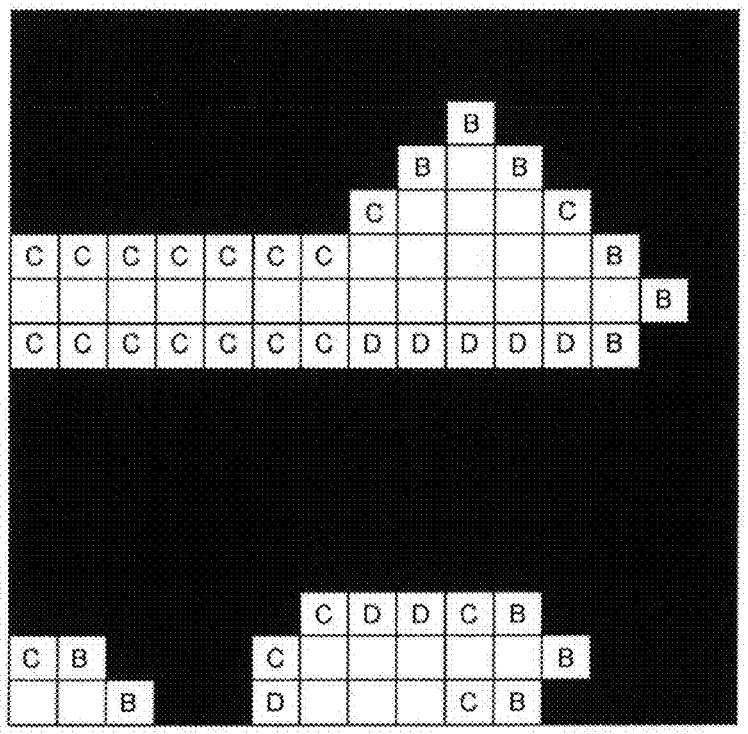
FIG. 33 is a partial enlarged view of the operation result illustrated in FIG. 32.

FIG. 32 is a schematic illustrating the result of performing an operation to the exemplary image data of the outlined image. FIG. 33 is a partial enlarged view of the operation result illustrated in FIG. 32.

FIGS. 32 and 33 illustrate flags set to the black dots adjacent to white dots, by performing the process of improving the reproducibility of very small characters to the image data of the outlined image illustrated in FIG. 31.

In the image data of the outlined image illustrated in FIG. 31, the flag D is set to the pixels of which BM value is one, the flag C is set to the pixels of which BM value is two, and the flag B is set to the pixels of which BM value is three.

In the image data of the outlined image illustrated in FIG. 31, because there is no pixel in which the number of black dots adjacent to a white dot is four, there is no pixel of which BM value is four, to which the flag A is to be set.

In other words, according to the embodiment, by setting a flag to a black dot based on the number of black dots adjacent to a white dot, reproducibility of very small characters can be improved without performing any character recognition such as edge processing.

Figure 34:
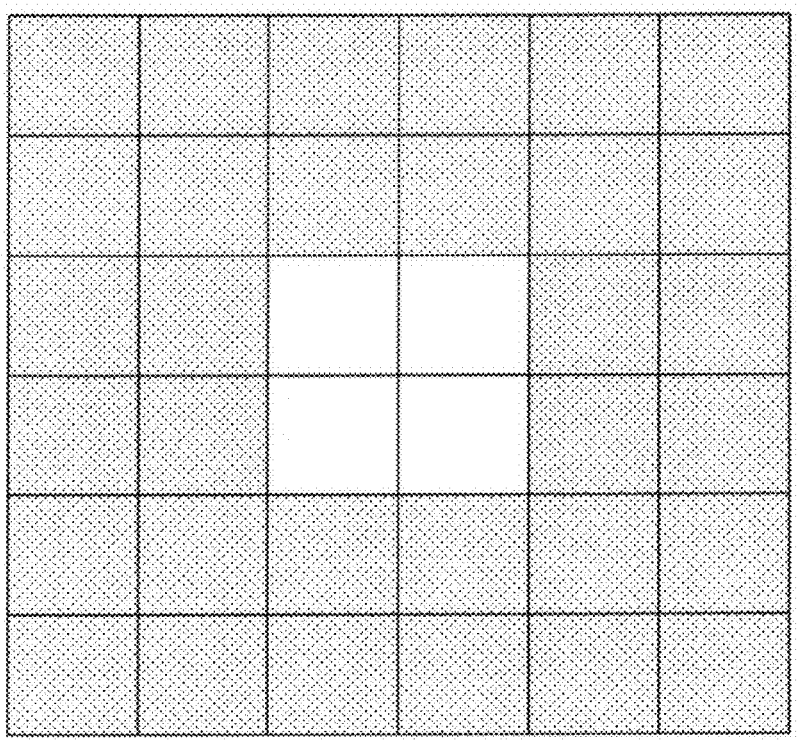
FIG. 34 is a schematic illustrating an example of a two-dot outlined image.

FIG. 34 is a schematic illustrating an example of a two-dot outlined image. The latent image forming conditions for the two-dot outlined image illustrated in FIG. 34 include a charge potential of −500 V, an azo-based organic photoconductor (OPC), a film thickness of 30 micrometers, a laser wavelength of 655 nanometers, and a dot density of 1200 dpi.

In FIG. 34, the part of the two dots to be output as an outlined image part illustrated in black are exposed with an amount of light of 100 percent and a duty ratio of 100 percent, while the white portions are not exposed.

Figure 35:
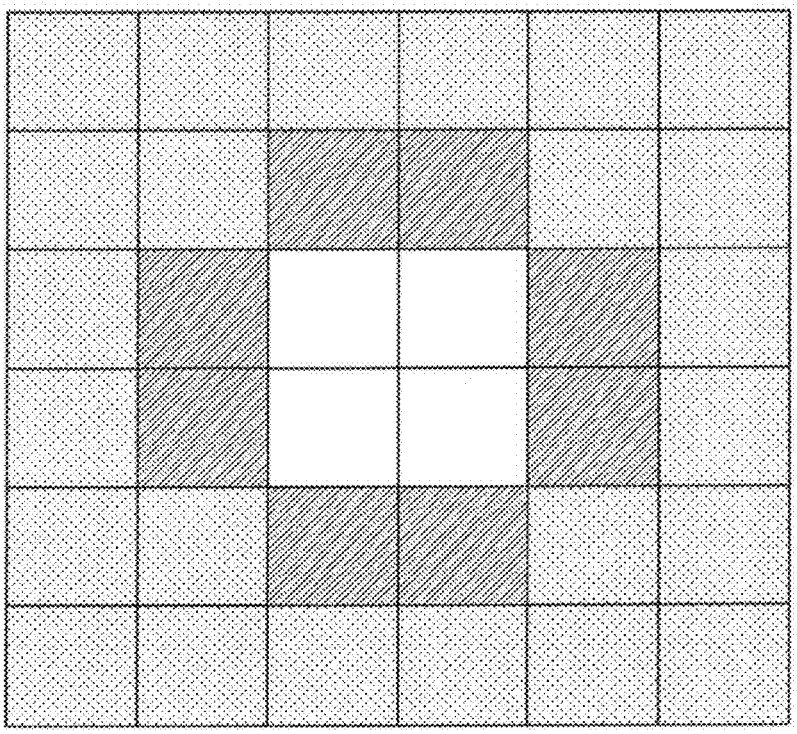
FIG. 35 is a schematic illustrating the pixels to which an optical output setting pattern is set in the two-dot outlined image.

FIG. 35 is a schematic illustrating the pixels to which an optical output setting pattern is set in the two-dot outlined image. In the two-dot outlined image illustrated in FIG. 35, an optical output pattern is set to the eight hatched pixels adjacent to the white dots.

According to the way in which the flags are set based on the BM values described above, the BM value of the hatched pixels is two, and therefore, the flag C is to be set to these pixels. The optical output value is then set based on the flag set to these eight pixels.

Figure 36:
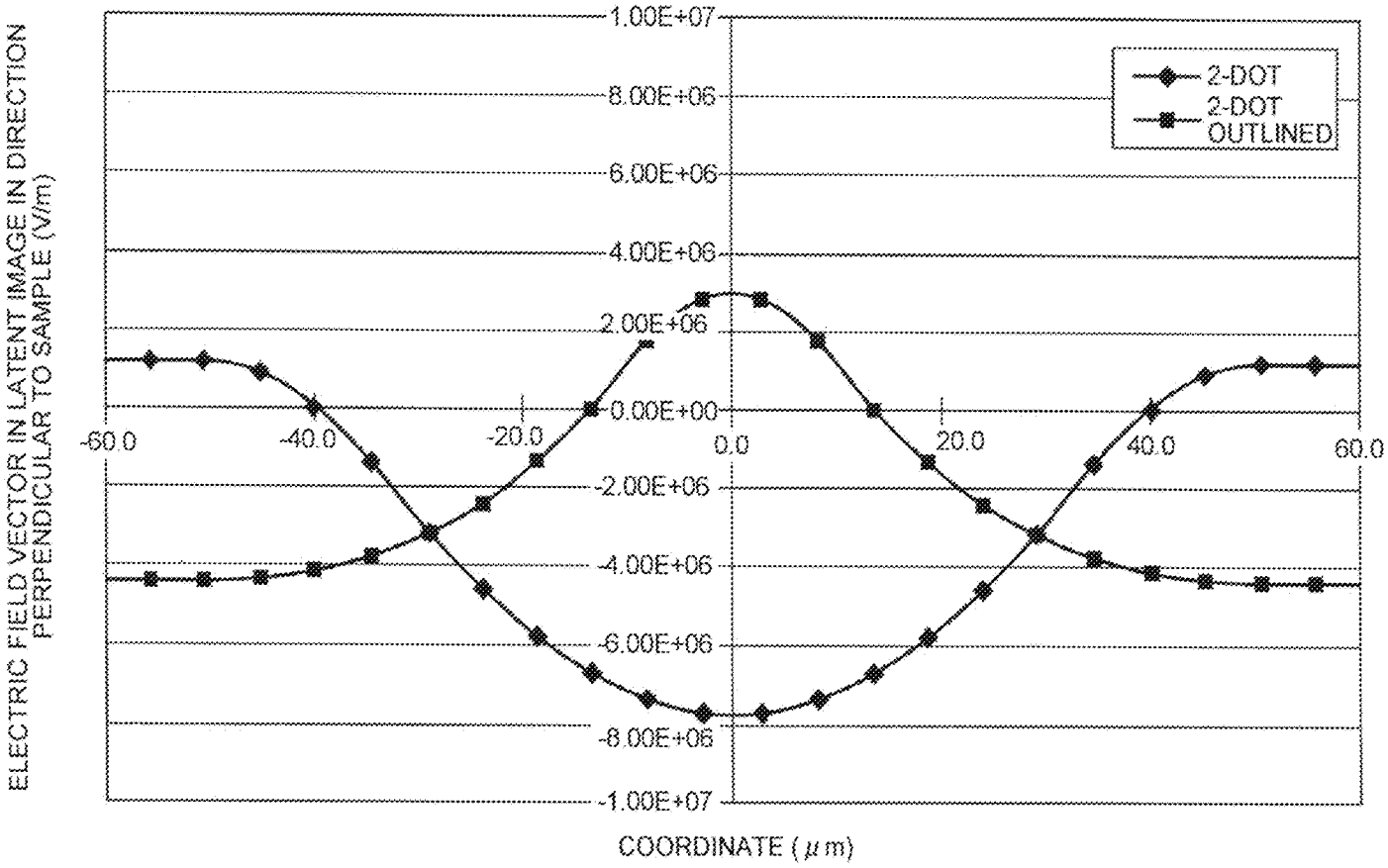
FIG. 36 is a schematic illustrating electric field vectors in the latent images of a two-dot ordinary image and of a two-dot outlined image in a direction perpendicular to the sample.

FIG. 36 is a schematic illustrating the electric field vectors in the latent images of a two-dot ordinary image and of a two-dot outlined image in the direction perpendicular to the sample. Illustrated in FIG. 36 are the electric field vectors in the latent images in the direction perpendicular to the sample when the two-dot ordinary image and the two-dot outlined image are exposed with an optical output based on the image pattern signal using the standard exposure.

As illustrated in FIG. 36, the electric field vector in the latent image of the two-dot outlined image in the direction perpendicular to the sample is extremely smaller than that in the latent image of the two-dot ordinary image. In other words, the electric field vector in the latent image of the two-dot outlined image in the direction perpendicular to the sample is not the reversal of the electric field vector in the latent image of the two-dot ordinary image in the direction perpendicular to the sample.

This indicates that a desired output image cannot be achieved when the two-dot outlined image is exposed with an optical output based on the image pattern signal using the standard exposure.

In the process of improving the reproducibility of very small characters in the embodiment, it is therefore preferable to set an optical output pattern in such a manner that a larger electric field vector in the latent image is produced accordingly to the scale of the BM value.

In the process of improving the reproducibility of very small characters in this embodiment, the electric field vector resulting from the standard exposure that is based on the image pattern signal represented as E0.

In the process of improving the reproducibility of very small characters in the embodiment, the electric field vector of when the BM value is one is represented as ED, and the electric field vector of when the BM value is two is represented as EC. The electric field vector of when the BM value is three is represented as EB, and the electric field vector of when the BM value is four is represented as EA.

In the process of improving the reproducibility of very small characters in this embodiment, it is preferable to form an electric field vector in the latent image in the direction perpendicular to the sample to satisfy a relation in Equation (1) below.

$$EA \geq EB \geq EC \geq ED \geq E0 \quad (1)$$

In Equation (1), a larger electric field vector in the latent image indicates a direction in which less toner is attached.

Figure 37:
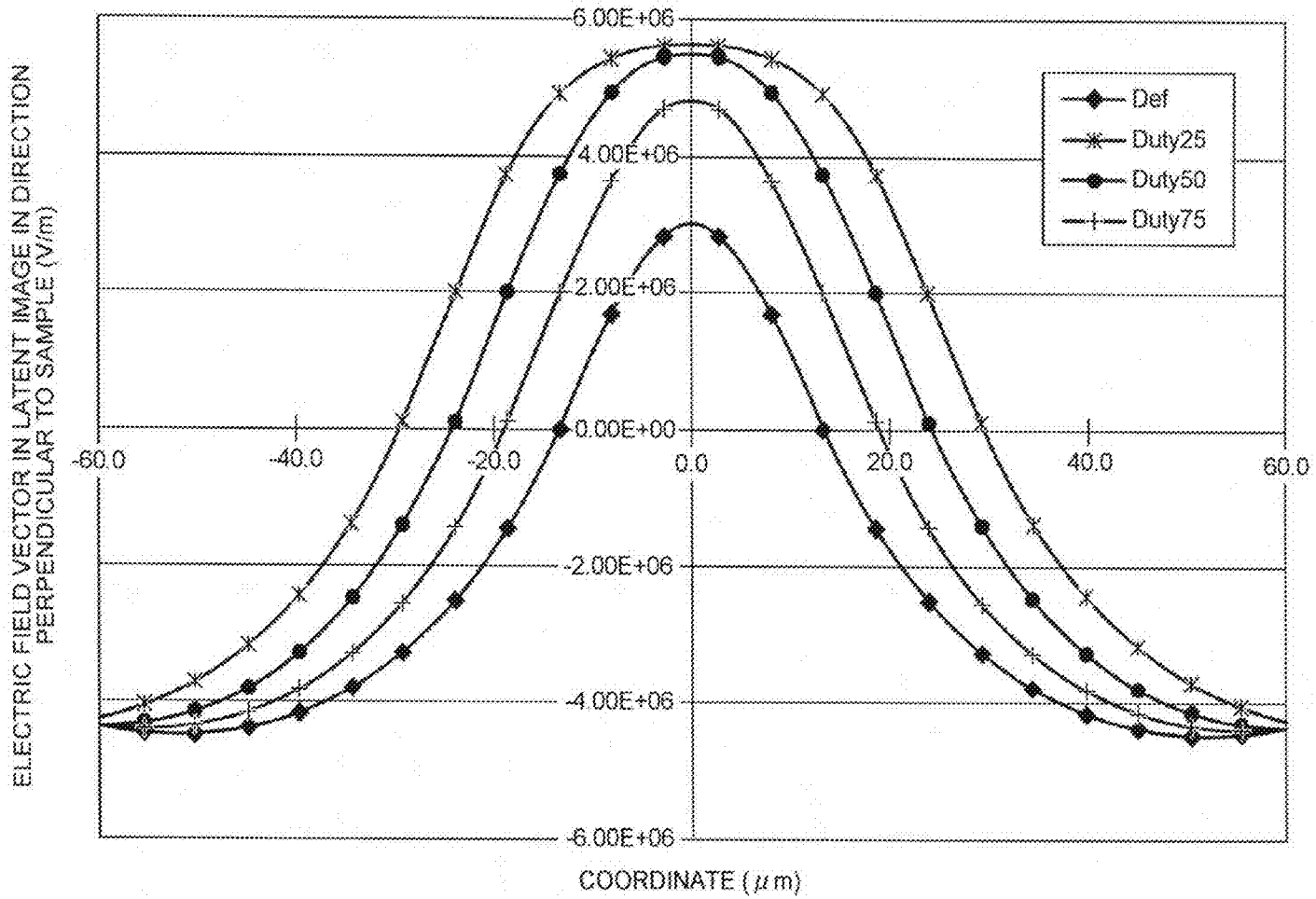
FIG. 37 is a schematic illustrating difference in the electric field vector in the latent image in the direction perpendicular to the sample, caused by difference in the optical output value based on PWM modulation.

FIG. 37 is a schematic illustrating difference in the electric field vector in the latent image in the direction perpendicular to the sample, caused by difference in the optical output value based on the PWM modulations.

In FIG. 37, the electrostatic latent image of the two-dot outlined image is formed while changing only the duty ratio, among the exposure conditions of the black dots adjacent to a white dot, from 75 percent to 50 percent, and to 25 percent with respect to the electric field vector achieved using the standard exposure with the image pattern signal. FIG. 37 illustrates a relation between an intensity of the c-axis electric field and a distance from the center of the electrostatic latent image of the two-dot outlined image, when the electrostatic latent image is formed in the manner described above.

When the exposure condition is set to a duty ratio of less than 100 percent, a black dot is exposed at timing away from a white dot.

With the standard exposure, the intensity of the c-axis electric field at the center of the electrostatic latent image was 2.88×106 V/m. When the duty ratio was set to 75 percent in the concentrated exposure, the intensity of the c-axis electric field at the center of the electrostatic latent image was 4.73×106 V/m, while it was 5.65×106 V/m with a duty ratio of 50 percent, and was 5.47×106 V/m with a duty ratio of 25 percent.

The exposure condition was changed only for the black dots adjacent to a white dot. In other words, FIG. 37 indicates that the intensity of the c-axis electric field in the white dots has changed although the exposure condition for the white dot is not changed. As the duty ratio is reduced, the intensity of the c-axis electric field in the white dots is increased, and therefore, less toner is attached.

As described above, in the process of improving the reproducibility of very small characters in this embodiment, by changing the duty ratio based on the flags set to the black dots adjacent to a white dot, an outlined image in which white dots are clearly delineated can be output.

In the process of improving the reproducibility of very small characters in the embodiment, the duty ratio may be set to zero percent (no illumination) in the black dots set with the flag A. In such a case, the duty ratio is set to 25 percent in the black dot with the flag B, the duty ratio is set to 50 percent in the black dot with the flag C, and the duty ratio is set to 75 percent in the black dot with the flag D. In such a case as well, because the relation EA≥EB≥EC≥ED is satisfied, it is possible to output an outlined image in which the white dots are clearly delineated.

Although the settings of the duty ratio may be fixed, it is more preferable to find appropriate settings for the actual device through experiments or the like, because the optimal settings of the duty ratio differ depending on devices.

Figure 38:
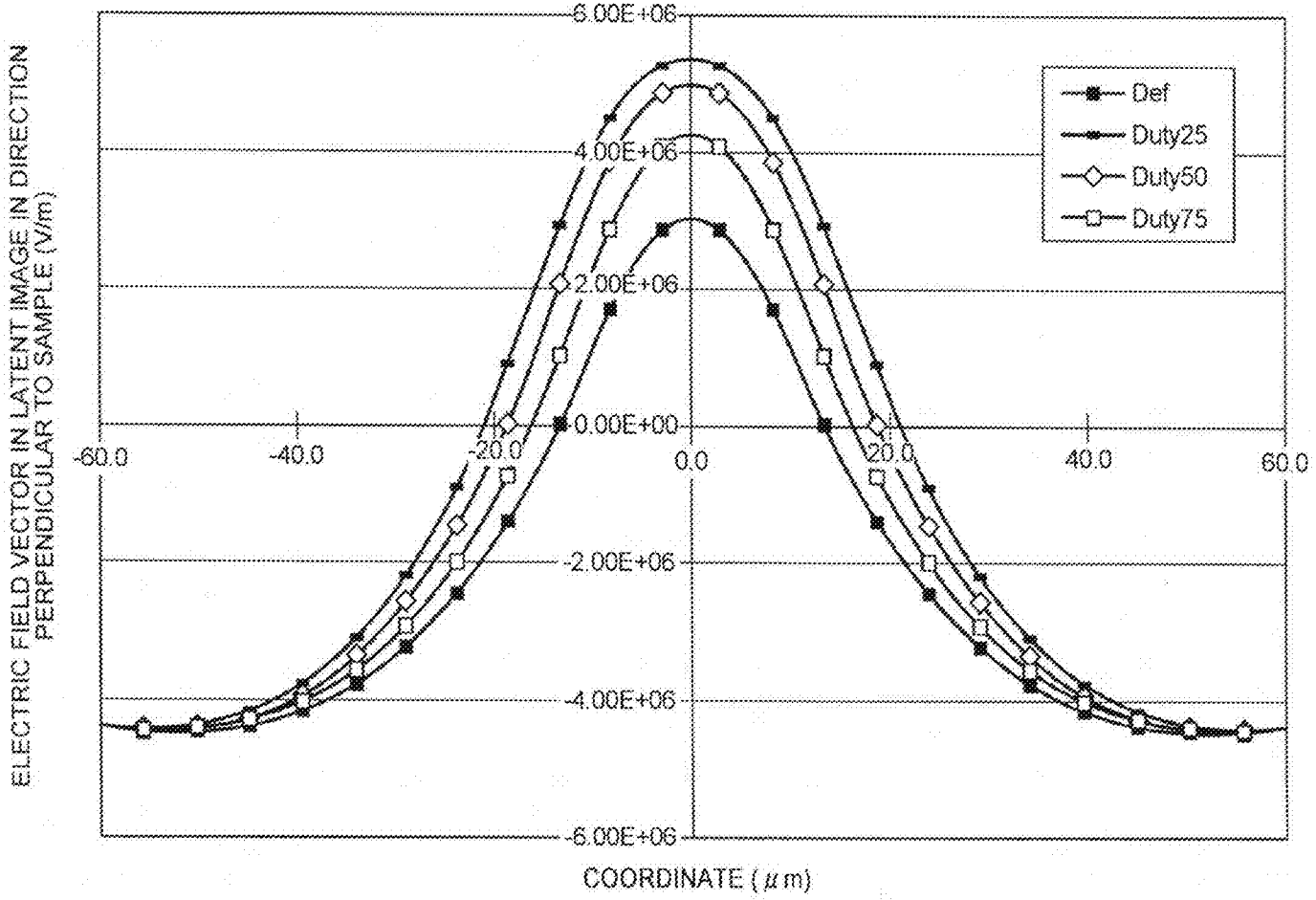
FIG. 38 is a schematic illustrating difference in the electric field vector in the latent image in the direction perpendicular to the sample, caused by difference in the optical output value based on PW modulation and the PWM modulation.
Figure 39:
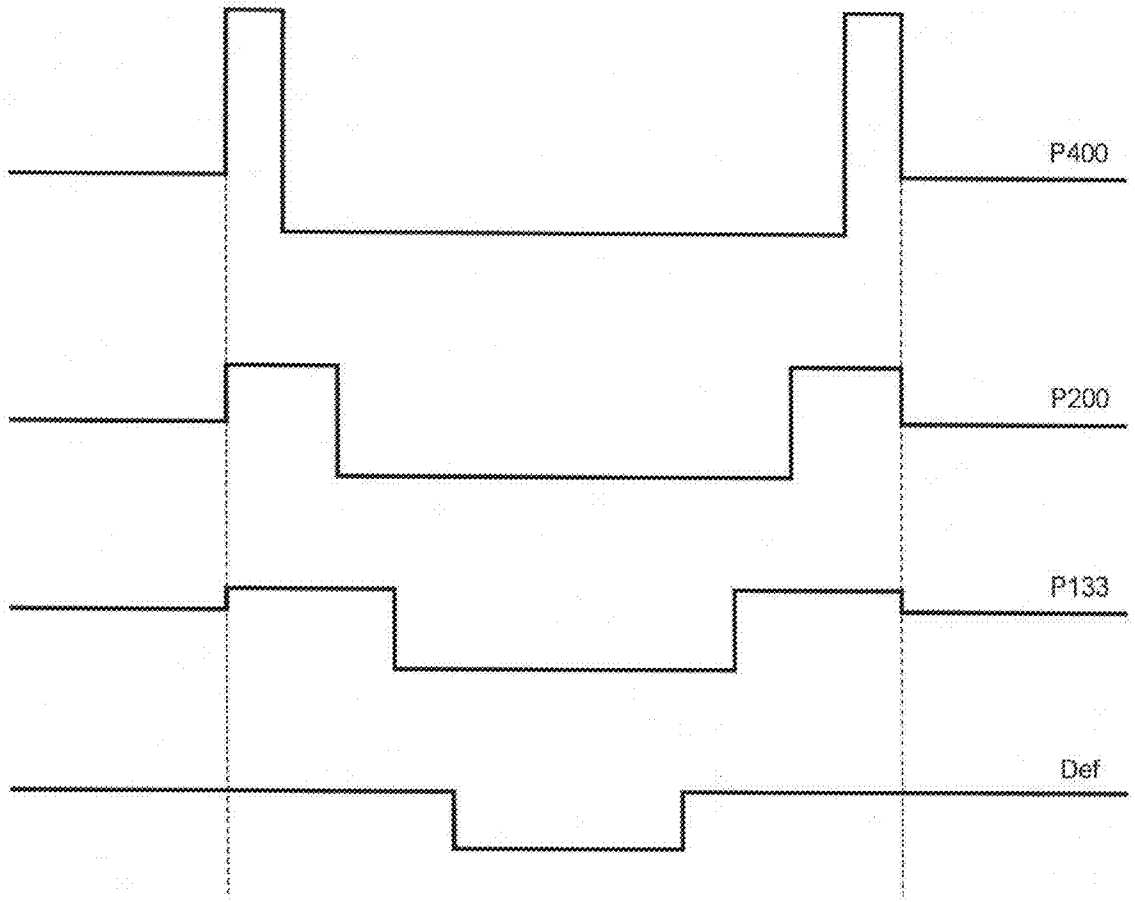
FIG. 39 is a schematic illustrating difference in the amount of optical output dispersion, caused by difference in optical output values based on the PW modulation and the PWM modulation.

FIG. 38 is a schematic illustrating difference in the electric field vector in the latent image in the direction perpendicular to the sample, caused by difference in the optical output value based on the PW modulation and the PWM modulation. FIG. 39 is a schematic illustrating difference in the amount of optical output dispersion, caused by difference in optical output value based on the PW modulation and the PWM modulation.

FIGS. 38 and 39 indicate a relation between an intensity of the c-axis electric field and a distance from the center of the electrostatic latent image of a two-dot outlined image, when such a latent image is formed by changing the optical output while reducing the length of the ON time, among the exposure conditions for the black dots adjacent to a white dot, in such a manner that the integrated amount of light is kept constant.

In FIGS. 38 and 39, the outlined image is exposed (concentrated-exposed) with higher optical outputs than that used in an ordinary black solid image, with the highest at 400 percent of that in the standard exposure, denoted by P400, and 200 percent denoted by P200, and 133 percent denoted by P133.

With the concentrated exposure according to the embodiment, the latent image is exposed with a stronger optical output over a shorter ON time, that is, exposed in a concentrated fashion, being concentrated with respect to time. Therefore, according to the embodiment, the electric field of the latent image can be brought up (increased) in an outlined image portion, so that the latent image resolving power can be improved while maintaining the density of the black pixels.

A prominent characteristic of the concentrated exposure is in that the overall image density remains substantially the same because the integrated amount of light remains the same.

Furthermore, with the concentrated exposure, because the range of the c-axis electric field intensity is narrow, compared with the method in which the duty ratio or the modulation current is changed based on the BM values, the resolving power is maintained while the intensity of the c-axis electric field is increased.

Furthermore, the concentrated exposure has some outstanding advantages, e.g., images are less degraded, and developing γ is stored, and halftone images are more likely to be supported. In other words, in the process of improving the reproducibility of very small characters in the image forming method according to the present invention, it is more effective in adjustment of the exposure conditions by combining the PM modulation and the PWM modulation.

Light Source Driving Unit

The following describes a light source driving unit for the image forming apparatus according to the present invention executing the image forming method according to the present invention.

Figure 40:
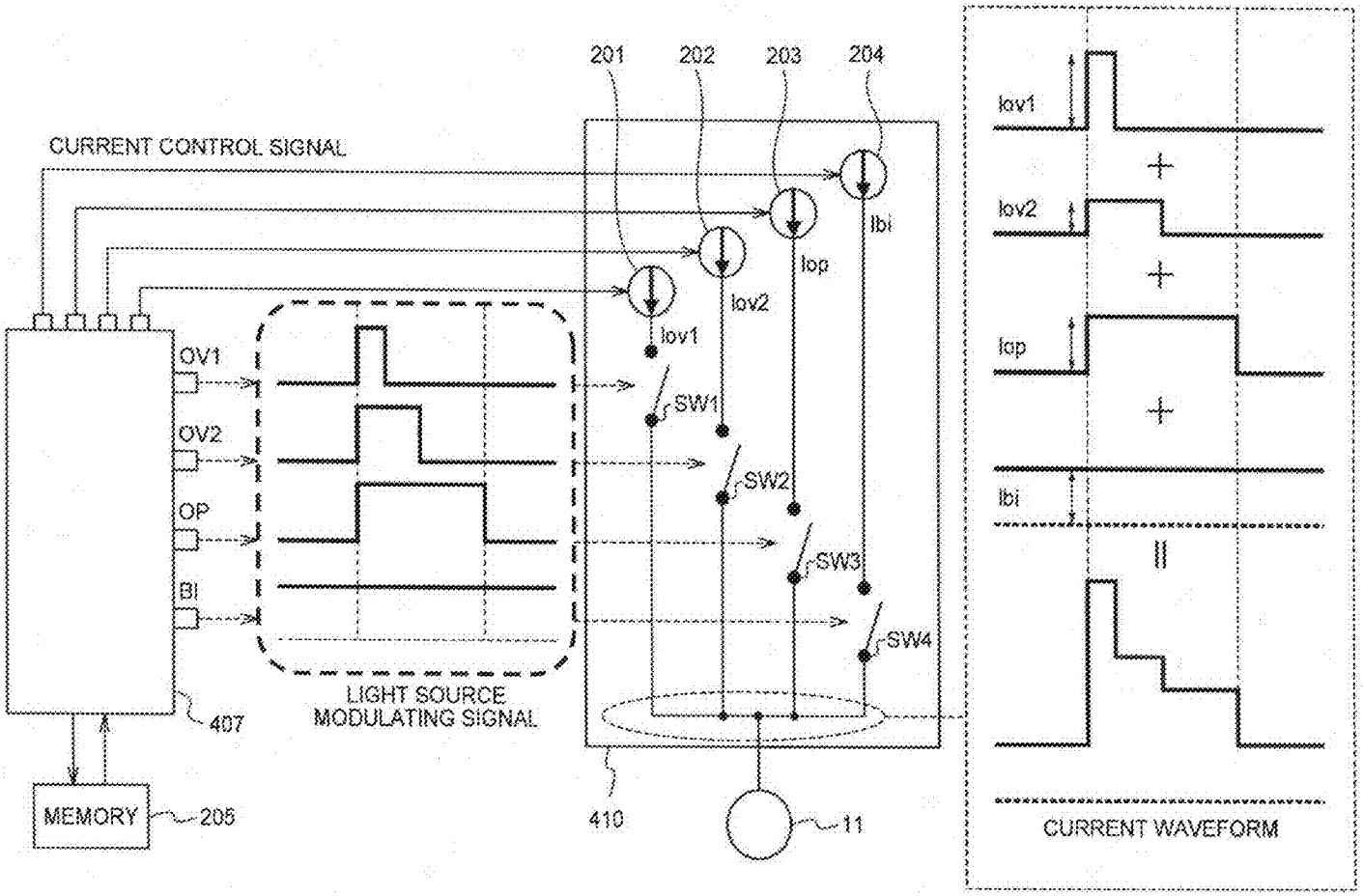
FIG. 40 is a circuit diagram of a light source driving unit provided to the image forming apparatus.

FIG. 40 is a circuit diagram of the light source driving unit provided to the image forming apparatus. As illustrated in FIG. 40, this light source driving unit 410 includes current sources 201 to 204, switches SW1 to SW4, and a memory 205. The light source driving unit 410 is connected to an image processing circuit 407.

The image forming apparatus according to the present invention executing the image forming method according to the present invention allows the photosensitive element to be exposed while changing the optical output value based on the position in an image portion in the main-scanning direction (correspondingly to the time elapsed from when the image portion is started being exposed). With the configuration illustrated in FIG. 40, the light source driving unit 410 can generate a light source driving current by performing the pulse width modulation and the light amount modulation (the PWM modulation and the PW modulation) simultaneously.

Generally, a current waveform is generated by adding a bias current (Ibi), a basic pattern current (Iop), and overshoot currents (Iov1, Iov2).

The current source 201 generates the overshoot current Iov1. The current source 202 generates the overshoot current Iov2. The current source 203 generates the basic pattern current Iop. The current 204 generates the bias current Ibi.

The current generated by the light source driving unit 410 is determined by causing the current sources 201 to 204 to be controlled by the current control signals output from the image processing circuit 407.

The switches SW1 to SW4 are provided correspondingly to the respective current sources 201 to 204. The switches SW1 to SW4 are controlled by light source modulation signals output from the image processing circuit 407. The switches SW1 to SW4 control the flow of the current sources 201 to 204, thereby generating a pattern of a pulse to be generated by the light source driving unit 410.

The memory 205 corresponds to a storage unit, and stores therein information required in generating a light source driving current. The image processing circuit 407 refers to the information stored in the memory 205.

Because the light source driving unit 410 can convert a light source modulation signal acquired from a piece of light source modulation data into a current, the image forming apparatus according to the present invention can provide a PM- and PWM-modulation capable of controlling the optical output and the ON time.

Figure 41:
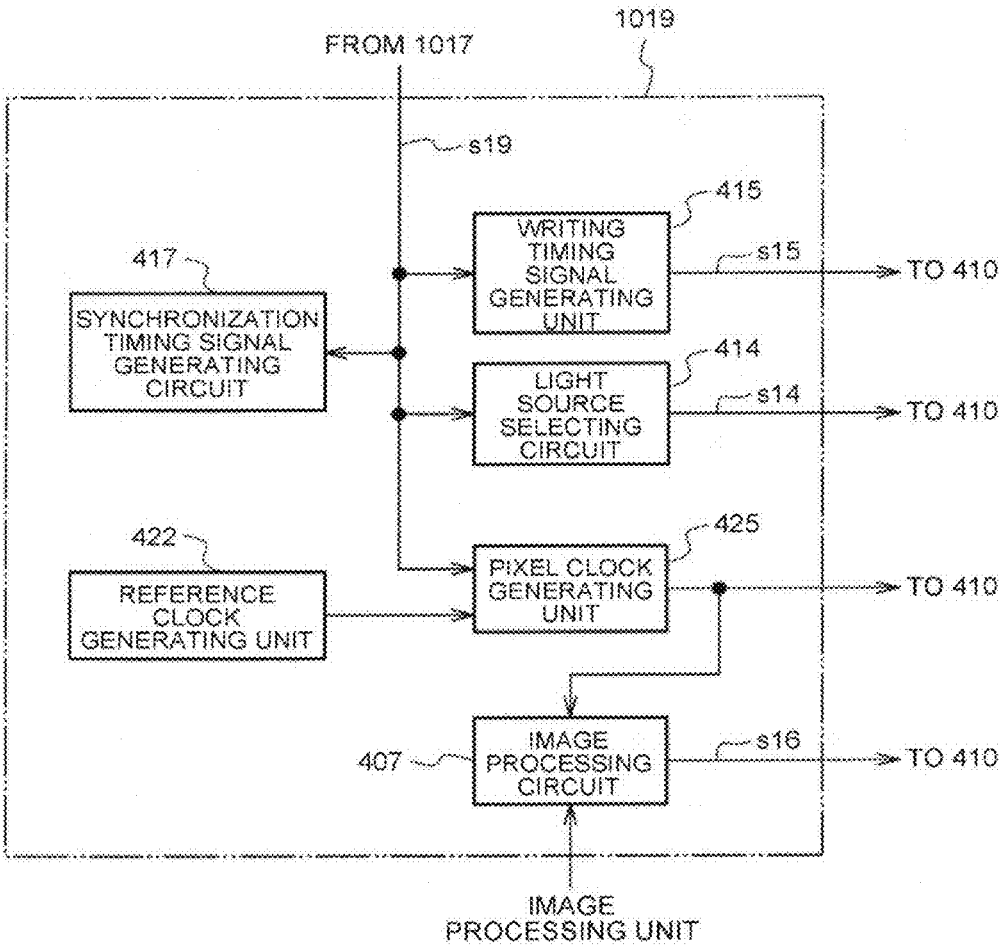
FIG. 41 is a block diagram illustrating a light source drive control unit provided to the light source driving unit.

FIG. 41 is a block diagram illustrating a light source drive control unit. As illustrated in FIG. 41, this light source drive control unit 1019 includes a reference clock generating unit 422 and a pixel clock generating unit 425. The light source drive control unit 1019 includes the image processing circuit 407, a light source selecting circuit 414, a writing timing signal generating unit 415, and a synchronization timing signal generating circuit 417.

The flows of representative signals or information are indicated by the arrows in FIG. 41, but these arrows do not represent every connection between the blocks.

The reference clock generating unit 422 generates a high frequency clock signal that is used as a reference in the entire light source drive control unit 1019.

The main component of the pixel clock generating unit 425 is a phase-locked loop (PLL) circuit. The pixel clock generating unit 425 generates a pixel clock signal based on the synchronization signal s19 and the high frequency clock signal from the reference clock generating unit 422.

The pixel clock signal has the same frequency as the high frequency clock signal, and the phase of the pixel clock signal is matched with the phase of the synchronization signal s19.

The pixel clock generating unit 425 can therefore control the writing position for each scan, by synchronizing the image data to the pixel clock signal.

The pixel clock generating unit 425 supplies the generated pixel clock signal to the light source driving unit 410 as a piece of driving information, and to the image processing circuit 407. The pixel clock signal supplied to the image processing circuit 407 is used as a clock signal for write data s16.

The light source selecting circuit 414 is a circuit used when the light source is provided in plurality, and outputs a signal for designating a selected light-emitting element. This output signal s14 from the light source selecting circuit 414 is supplied to the light source driving unit 410 as a piece of driving information.

Figure 42:
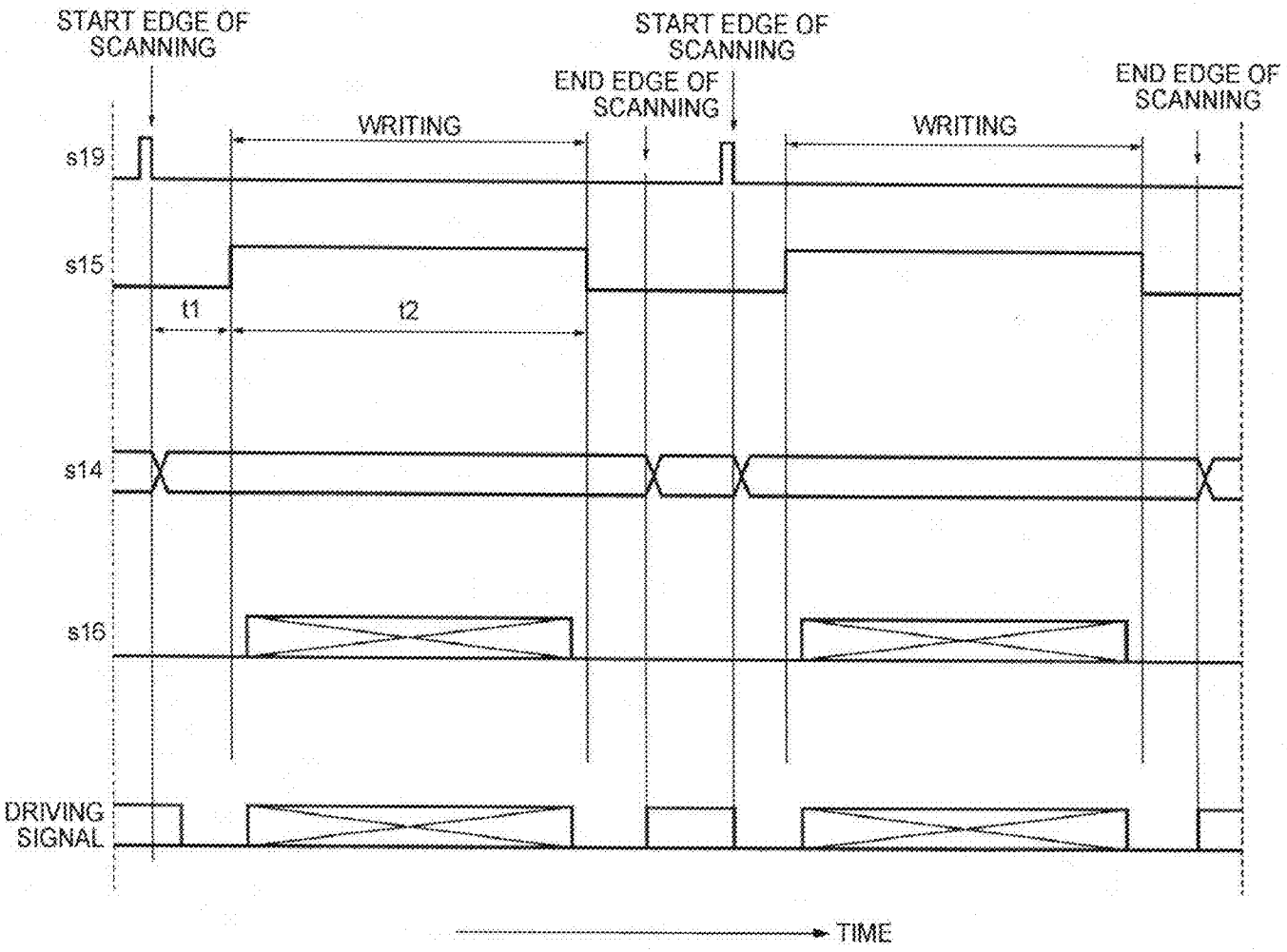
FIG. 42 is a timing chart illustrating the timing at which each of the units in the image forming apparatus operates.

FIG. 42 is a timing chart illustrating the timing at which each of the units in the image forming apparatus operates. In FIG. 42, s19 denotes an output signal (synchronization signal) from a synchronization detection sensor 26; s15 denotes an output signal (LGATE signal) from the writing timing signal generating unit 415; s14 denotes an output signal from the light source selecting circuit 414, and s16 denotes write data that is an output from the image processing circuit 407.

The image processing circuit 407 creates a piece of write data s16 for each of the light-emitting elements based on the image information received from the IPU or the like. The write data s16 is supplied to the light source driving unit 410, as a piece of driving information, at the timing of the pixel clock signal.

Structure of Electrostatic Latent Image Measurement Apparatus

The following describes a structure of an electrostatic latent image measurement apparatus.

Figure 43:
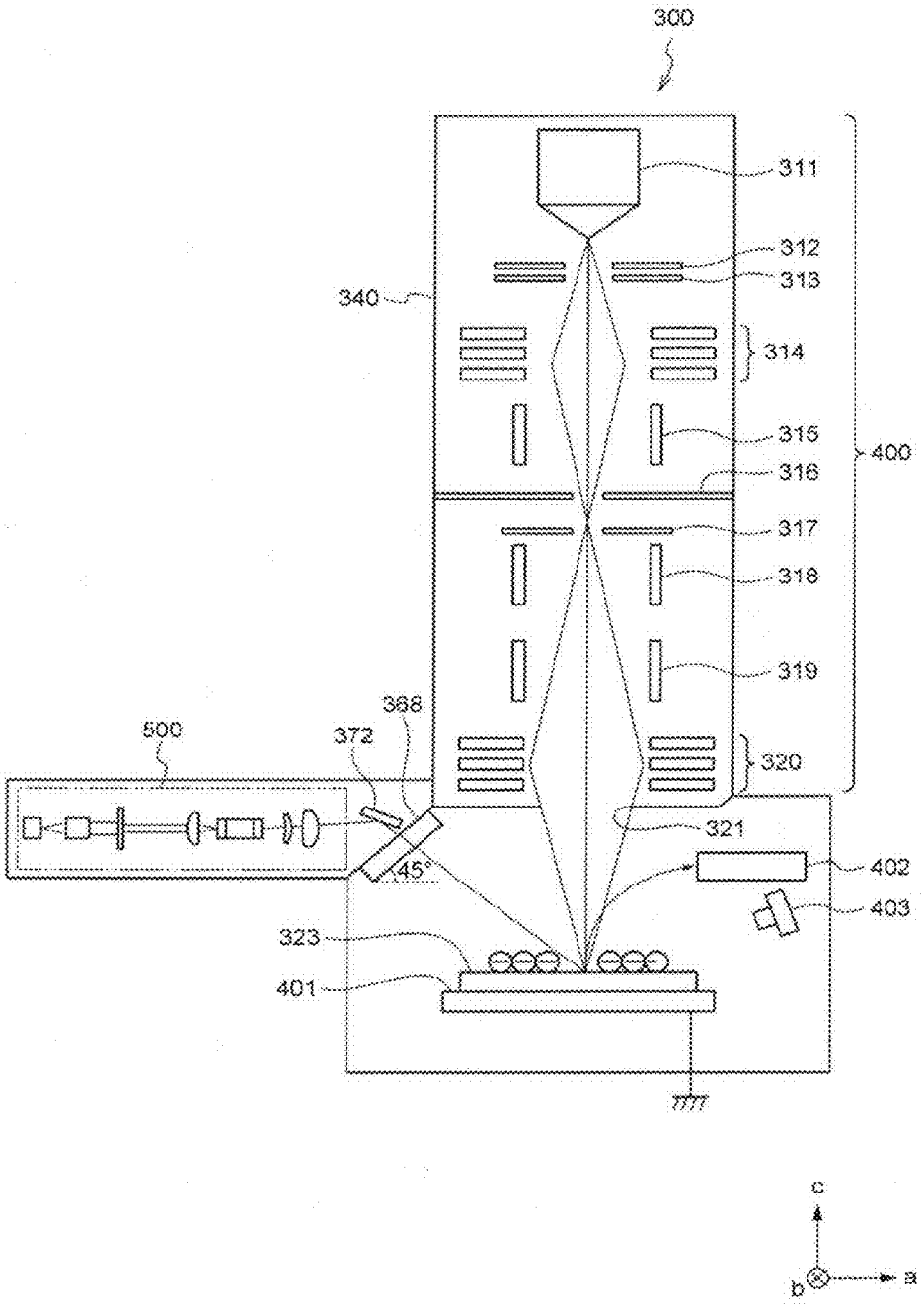
FIG. 43 is a cross-sectional view across the center of an electrostatic latent image measurement apparatus.

FIG. 43 is a cross-sectional view across the center of an electrostatic latent image measurement apparatus.

This electrostatic latent image measurement apparatus 300 includes a charged particle output system 400, an optical scanning device 1010, a platform 401, a detector 402, and an LED 403, and a control system, a discharge system, and a driving power supply not illustrated.

The charged particle output system 400 is placed inside of a vacuum chamber 340. The charged particle output system 400 includes an electron gun 311, an extraction electrode 312, an accelerating electrode 313, condenser lenses 314, a beam blanker 315, and a partitioning plate 316. The charged particle output system 400 also includes a movable aperture 317, a stigmator 318, a scanning lens 319, and objective lenses 320.

In the explanation hereunder, the direction of the optical axis of the lenses is referred to as a c-axial direction, and two directions that are perpendicular to each other on a plane perpendicular to the c-axial direction are referred to as an a-axial direction and a b-axial direction, respectively.

The electron gun 311 generates an electron beam as a charged particle beam.

The extraction electrode 312 is positioned in the −c direction from the electron gun 311, and controls the electron beam generated by the electron gun 311.

The accelerating electrode 313 is positioned in the −c direction from the extraction electrode 312, and controls the energy of the electron beam.

The condenser lenses 314 are positioned in the −c direction from the accelerating electrode 313, and condense the electron beam.

The beam blanker 315 is positioned in the −c direction from the condenser lenses 314, and turns ON or OFF the electron beam.

The partitioning plate 316 is positioned in the −c direction from the beam blanker 315, and has an opening at the center.

The movable aperture 317 is positioned in the −c direction from the partitioning plate 316, and adjusts the beam diameter of the electron beam passed through the opening of the partitioning plate 316.

The stigmator 318 is positioned in the −c direction from the movable aperture 317, and corrects the astigmatism.

The scanning lens 319 is positioned in the −c direction from the stigmator 318, and deflects the electron beam passed through the stigmator 318 on the a-b plane.

The objective lenses 320 are positioned in the −c direction from the scanning lens 319, and converge the electron beam passed through the scanning lens 319. The electron beam passed through the objective lenses 320 passes through a beam output opening 321, the beam with which the surface of a sample 323 is irradiated.

The driving power supply not illustrated is connected to the lenses and the like.

Charged particles are particles that are affected by an electric field or a magnetic field. The beam in which the charged particles are output may be an ion beam, for example, instead of an electron beam. In such a case, a liquid-metal ion gun, for example, is used instead of the electron gun.

The sample 323 is a photosensitive element, and has a conductive supporting member, a charge generation layer (CGL), and a charge transport layer (CTL).

The CGL contains a charge generation material (CGM), and formed on the +c-side surface of the conductive supporting member. The CTL is formed on the +c-side surface of the CGL.

When the sample 323 of which surface (+c side surface) is charged is exposed, the light is absorbed by the CGM in the CGL, and charge carriers of both polarities, that is, positive charge carriers and negative charge carriers, are generated. One of the carriers is injected on the CTL by an electric field, and the other is injected on the conductive supporting member.

The electric field moves the carriers injected on the CTL to the surface of the CTL, and the carriers become coupled to the charges on the surface and disappear. Through this process, a charge distribution, that is, an electrostatic latent image is formed on the surface (+c side surface) of the sample 323.

The optical scanning device 1010 includes a light source, a coupling lens, an aperture plate, a cylindrical lens, a polygon mirror, and a scanning optical system. The optical scanning device 1010 also includes a scanning mechanism (not illustrated) for scanning light in a direction in parallel with the rotating shaft of the polygon mirror.

The light output from the optical scanning device 1010 is reflected on a reflecting mirror 372 and passes through a glass window 368, and the surface of the sample 323 is irradiated with the light.

The position irradiated with the light output from the optical scanning device 1010 moves across the surface of the sample 323, in two directions that are perpendicular to each other on a plane orthogonal to the c-axial direction, depending on how the light is deflected on the polygon mirror and the scanning mechanism. The irradiated position moves in the main-scanning direction as the light is deflected on the polygon mirror, and moves in the sub-scanning direction as the light deflected in the scanning mechanism. In this example, the a-axial direction is set to the main-scanning direction, and the b-axial direction is set to the sub-scanning direction.

In this manner, the electrostatic latent image measurement apparatus 300 can scan the surface of the sample 323 two-dimensionally, with the light output from the optical scanning device 1010. In other words, the electrostatic latent image measurement apparatus 300 can form a two-dimensional electrostatic latent image on the surface of the sample 323.

The optical scanning device 1010 is installed outside of the vacuum chamber 340 so that the trajectory of the electron beam is not affected by the vibrations caused by the driving motor for the polygon mirror, or electromagnetic waves. In this manner, the effects of disturbance on the measurement results can be reduced.

The detector 402 is positioned near the sample 323, and detects the secondary electrons from the sample 323.

The LED 403 is positioned near the sample 323, and outputs the light for illuminating the sample 323. The LED 403 is used in neutralizing the remaining charges on the surface of the sample 323, after a measurement is conducted.

The optical housing for supporting the scanning optical system may cover the entire scanning optical system so that the external light (harmful light) is blocked before entering the vacuum chamber.

In the scanning optical system, the scanning lens has fθ characteristics, and is configured in such a manner that the beam moves at a uniform velocity with respect to the image plane while the deflector is rotating at a constant velocity. The scanning optical system is also capable of scanning while keeping the beam spot size almost constant.

In the electrostatic latent image measurement apparatus 300, because the scanning optical system is positioned away from the vacuum chamber, the measurements are less affected by the vibration generated in driving the optical deflectors, such as a polygon scanner, directly communicated to the vacuum chamber 340.

By vibration-proofing the structure not illustrated for supporting the scanning optical system, higher vibration-proofing can be achieved.

By providing the scanning optical system to the electrostatic latent image measurement apparatus 300, any latent image pattern including a line pattern can be formed in the longitudinal direction of the photosensitive element.

A synchronization detection sensor 26 for detecting a scanning beam from the optical deflector may be provided to form a latent image pattern at a given position.

The surface of the sample may be flat or curved.

Method of Measuring Electrostatic Latent Image

The following describes a method of measuring an electrostatic latent image.

Figure 44:
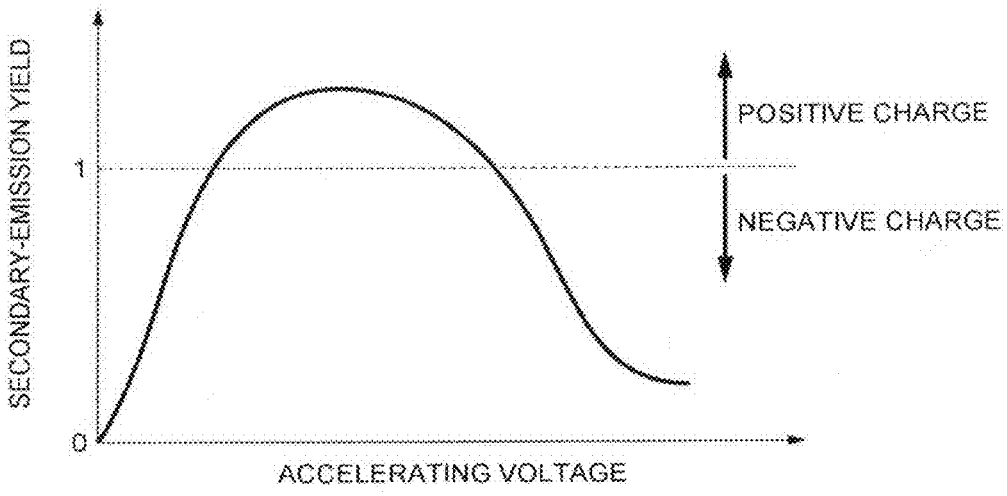
FIG. 44 is a schematic illustrating a relation between an accelerating voltage and a charge.

FIG. 44 is a schematic illustrating a relation between an accelerating voltage and a charge. Before measuring any electrostatic latent image, a sample 323 of a photosensitive element is irradiated with an electron beam in the electrostatic latent image measurement apparatus 300.

As illustrated in FIG. 44, as an accelerating voltage |Vacc| that is a voltage applied to the accelerating electrode 313 is set higher than the level resulting in a secondary-emission yield of the sample 323 of one. By setting the accelerating voltage in this manner, the amount of incident electrons exceeds the amount of ejected electrons, thereby allowing the electrons to be accumulated in the sample 323 and causing charge-up. As a result, the electrostatic latent image measurement apparatus 300 can uniformly charge the surface of the sample 323 with the negative charge.

Figure 45:
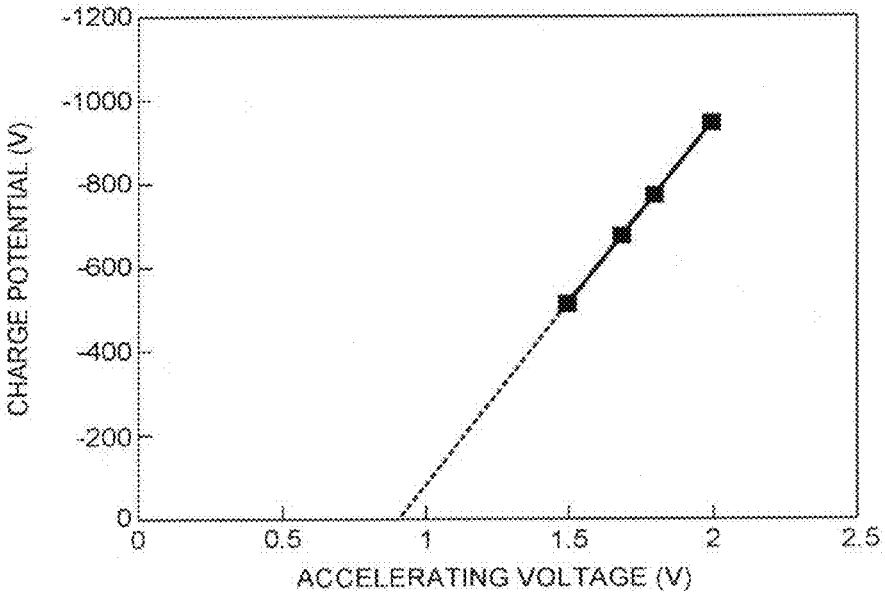
FIG. 45 is a graph illustrating a relation between the accelerating voltage and a charge potential.

FIG. 45 is a graph illustrating a relation between the accelerating voltage and the charge potential. As illustrated in FIG. 45, a constant relation is established between the accelerating voltage and the charge potential. In the electrostatic latent image measurement apparatus 300, therefore, by setting the accelerating voltage and irradiation time appropriately, a charge potential that is the same as that on the photosensitive drum 1030 in the image forming apparatus 1000 can be formed on the surface of the sample 323.

Because a higher irradiation current can achieve the target charge potential in a shorter time period, the irradiation current is set to a few nanoamperes, in this example.

In the electrostatic latent image measurement apparatus 300, the amount of electrons incident on the sample 323 is adjusted to 1/100 times to 1/1000 times so that the electrostatic latent image can be observed.

In the electrostatic latent image measurement apparatus 300, the optical scanning device 500 is controlled to scan the surface of the sample 323 two-dimensionally, thereby forming an electrostatic latent image on the sample 323. The optical scanning device 500 is adjusted so that the beam spot with a desired beam diameter and beam profile is formed on the surface of the sample 323.

The exposure energy required for forming an electrostatic latent image is usually 2 to 10 $mJ/m^2$ or so, depending on the sensitivity characteristics of the sample. For less sensitive samples, exposure energy of 10 $mJ/m^2$ or more may be required. In other words, the charge potential and the exposure energy required are set depending on the photosensitivity characteristics of the sample and the processing conditions. The exposure conditions in the electrostatic latent image measurement apparatus 300 are set to the same exposure conditions suitable for the image forming apparatus 1000.

Figure 46:
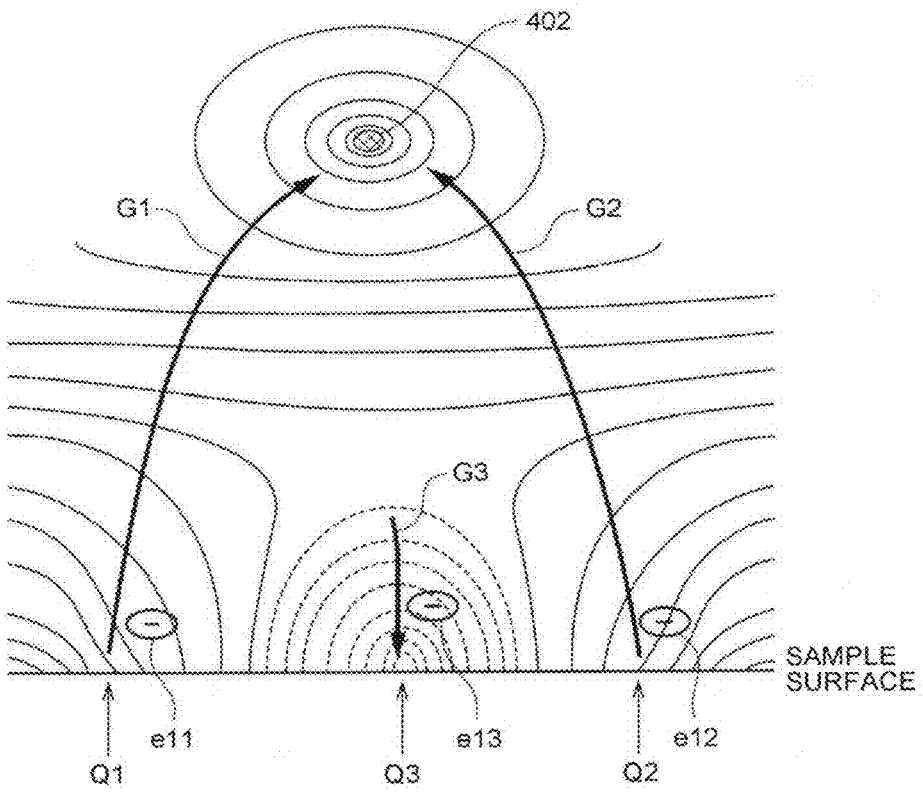
FIG. 46 is a schematic illustrating an electric potential distribution formed by secondary electrons above the sample surface.

FIG. 46 is a schematic illustrating an electric potential distribution formed by the secondary electrons above the sample surface. In FIG. 46, the distribution of the electric potential in the space between the detector 402 capturing the charged particles and the sample 323 is represented as a contour map, for the purpose of explanation.

While the surface of the sample 323 is uniformly charged to the negative polarity except for the part where the electric potential is attenuated due to the optical attenuation, the detector 402 is applied with a positive electric potential. The electric potential represented by the contour in solid lines is therefore higher at positions nearer to the detector 402 and further away from the surface of the sample 323.

In FIG. 46, therefore, secondary electrons el1 and el2 respectively generated at a point Q1 and a point Q2 both of which are uniformly charged to the negative polarity are attracted by the positive electric potential of the detector 402, and displaced in directions indicated by the arrow G1 and the arrow G2, respectively, and are captured by the detector 402.

By contrast, a point Q3 in FIG. 46 is a part having irradiated with the beam so that the negative electric potential of this part is attenuated. Near the point Q3, a series of electric potential contour lines spread like semi-circular "ripples" with the center at the point Q3, as illustrated in dotted lines. The ripple-like electric potential distribution represents higher electric potential at positions nearer to the point Q3.

In other words, an electrical force in the direction holding back a secondary electron toward the sample 323 acts on the secondary electron el3 generated near the point Q3, as indicated by the arrow G3. The secondary electrons el3 is so captured in a potential hole represented by the electric potential contour lines in dotted lines, and becomes incapable of traveling toward the detector 402.

Figure 47:
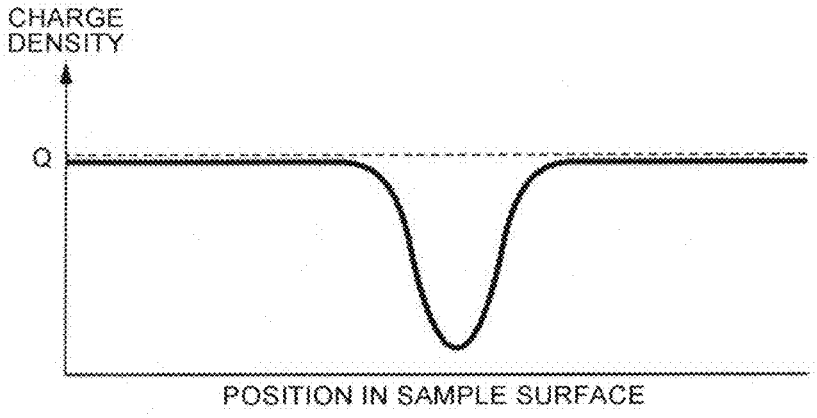
FIG. 47 is a schematic illustrating a charge distribution formed by the secondary electrons above the sample surface.

FIG. 47 is a schematic illustrating a charge distribution formed by the secondary electrons above the sample surface. In FIG. 47, the potential hole is schematically illustrated.

In other words, the portion where the detector 402 detects a higher secondary electron intensity (a larger number of secondary electrons) corresponds to the background of the electrostatic latent image (the part uniformly charged negatively, the part represented by the points Q1 and Q2 in FIG. 46). The portion where the detector 402 detects lower secondary electron intensity (a smaller number of secondary electrons) corresponds to the image portion of the electrostatic latent image (the portion irradiated with the beam, the portion represented by the point Q3 in FIG. 46).

By sampling the electrical signal output from the detector 402 at appropriate sampling intervals, a surface potential distribution (electric potential contrast image) V(a, b) can be identified for each "very small area corresponding to the sampling interval", having the sampling time T as a parameter.

The surface potential distribution V(a, b) may be acquired as two-dimensional image data, and displayed on a display device not illustrated or printed with a printer not illustrated, so that the electrostatic latent image as a visual image can be provided.

An electrostatic latent image can be output as a shading image based on the surface charge distribution, for example, by representing the intensity of captured secondary electrons as a range of light and dark shades, contrasting an image portion of the electrostatic latent image represented dark with a background portion represented light. If the surface potential distribution of an electrostatic latent image can be recognized, the surface charge distribution can also be recognized.

By acquiring the profile of the surface charge distribution or the surface potential distribution of an electrostatic latent image, the electrostatic latent image can be measured more precisely.

Figure 48:
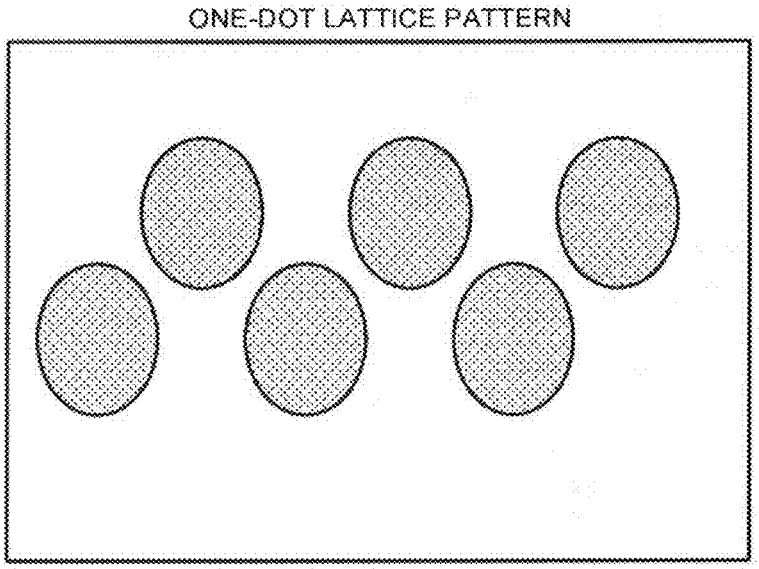
FIG. 48 is a schematic illustrating an exemplary latent image pattern formed with the scanning optical system.

FIG. 48 is a schematic illustrating an exemplary latent image pattern formed with the scanning optical system. An exemplary latent image pattern formed with the scanning optical system includes what is called a one-isolated dot pattern or lattice dot pattern illustrated in FIG. 48.

Figure 49:
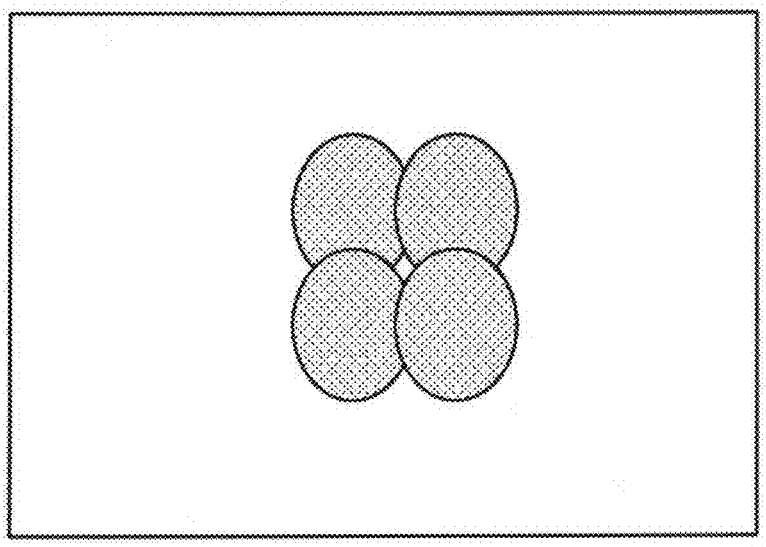
FIG. 49 is a schematic illustrating another exemplary latent image pattern formed with the scanning optical system.

FIG. 49 is a schematic illustrating another exemplary latent image pattern formed with the scanning optical system. Another exemplary latent image pattern formed with the scanning optical system includes what is called a two-isolated dot pattern illustrated in FIG. 49.

Figure 50:
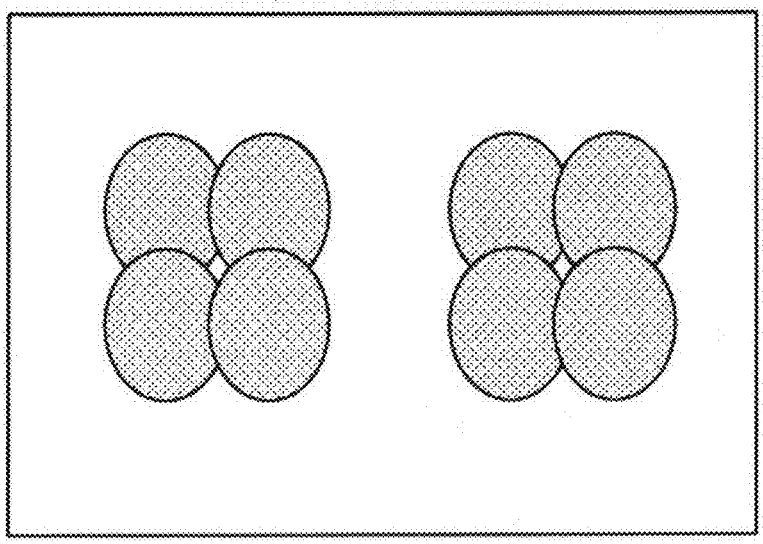
FIG. 50 is a schematic illustrating still another exemplary latent image pattern formed with the scanning optical system.

FIG. 50 is a schematic illustrating still another exemplary latent image pattern formed with the scanning optical system. Another exemplary latent image pattern formed with the scanning optical system includes what is called a two-by-two pattern illustrated in FIG. 50.

Figure 51:
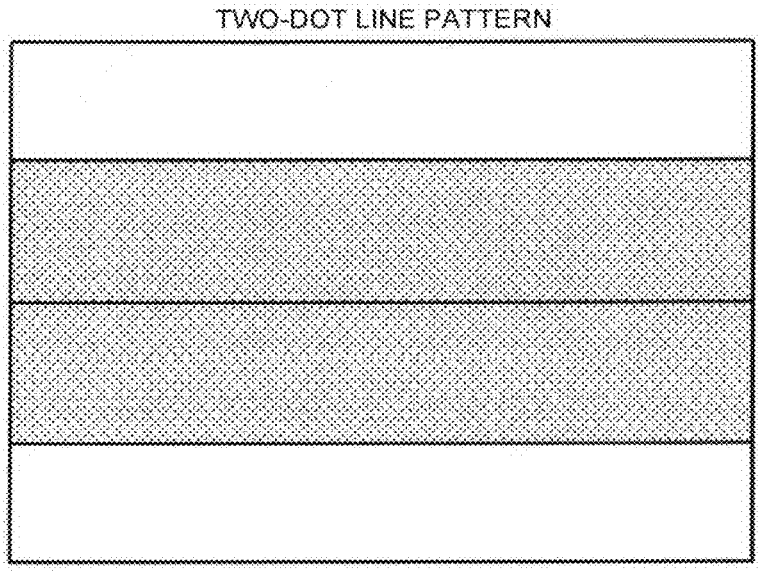
FIG. 51 is a schematic illustrating still another exemplary latent image pattern formed with the scanning optical system.

FIG. 51 is a schematic illustrating still another exemplary latent image pattern formed with the scanning optical system. Another exemplary latent image pattern formed with the scanning optical system includes what is called a two-dot line pattern, as illustrated in FIG. 51.

The scanning optical system may form latent images in various patterns, without limitation to those described above.

The target of detection by the detector 402 is not limited to the secondary electrons from the sample 323. The detector 402 may also detect, for example, the electrons repelled near the surface of the sample 323 before the electron beam becomes incident on the surface of the sample 323 (hereinafter, also referred to as "primary repulsive electrons").

Figure 52:
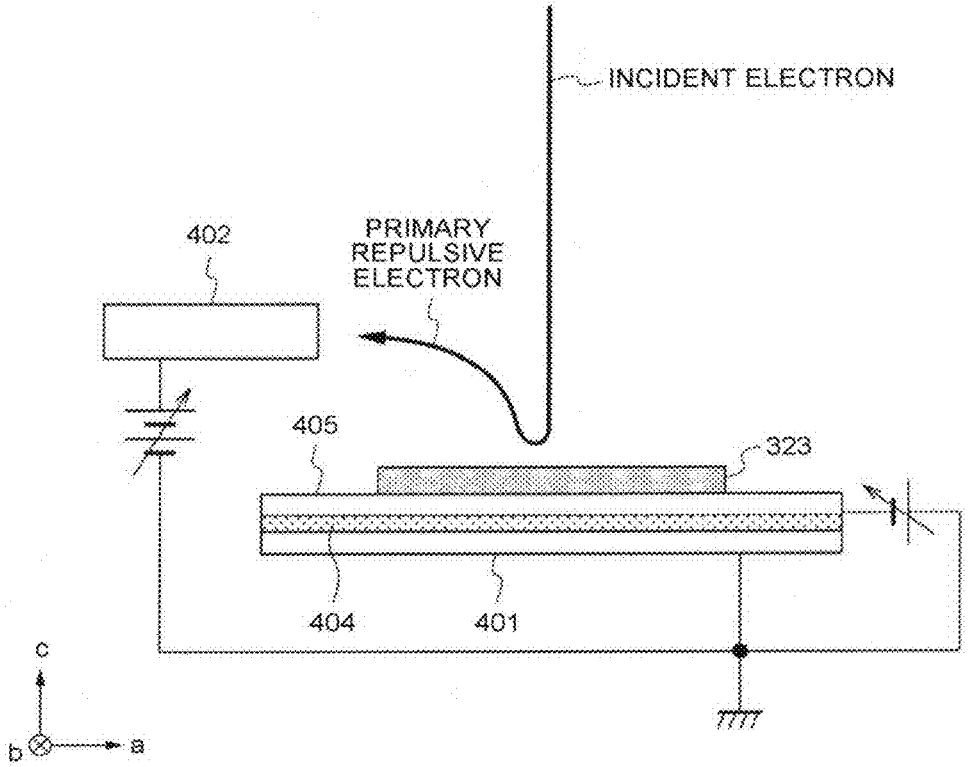
FIG. 52 is a cross-sectional view across the center in a measurement example with a grid-mesh arrangement.

FIG. 52 is a cross-sectional view across the center in a measurement example with a grid-mesh arrangement. As illustrated in FIG. 52, in this measurement example with the grid-mesh arrangement, an insulating member 404 and a conductive member 405 are provided between the platform 401 and the sample 323, and a ±Vsub voltage is applied to the conductive member 405.

This configuration allows the detector 402 to detect the primary repulsive electrons.

The detector 402 may be provided with a conductive plate facing the detector 402.

Despite the accelerating voltage is generally expressed as positive, the accelerating voltage is herein expressed as negative (Vacc<0) because Vacc is negative.

The electric potential of the sample 323 is denoted by Vp (<0).

Because an electric potential is the electrical potential energy per unit charge, the incident electrons at an electric potential of 0 (V) move at the speed of the accelerating voltage Vacc.

In other words, denoting the amount of charge of the electrons by e and denoting the mass of the electrons as m, the initial speed of electrons v0 can be expressed as mv02/2=e×|Vacc|. In the vacuum, the electrons move at a constant velocity in an area not affected by the accelerating voltage, due to the energy conservation law.

As the electrons approach the sample 323, the electric potential increases, and the electrons are repelled by the charge of the sample 323 due to the Coulomb repulsion, and become decelerated. As a result, a phenomenon described below generally occurs.

Figure 53:
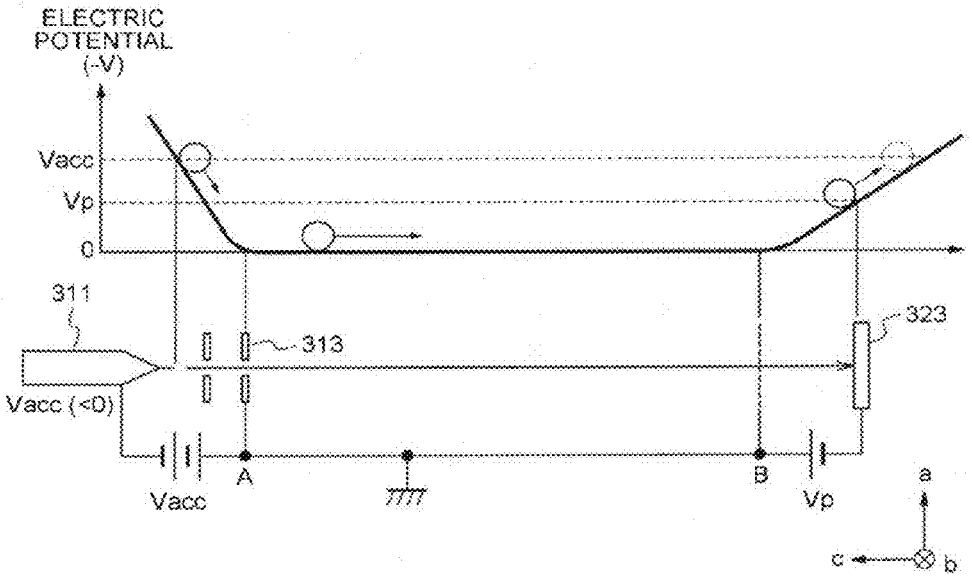
FIG. 53 is a schematic illustrating behavior of incident electrons when $|Vacc| \leq |Vp|$.

FIG. 53 is a schematic illustrating the behavior of the incident electrons when |Vacc|≥|Vp|. As illustrated in FIG. 53, when |Vacc|≥|Vp|, the incident electrons reach the sample 323 despite the incident electrons become decelerated.

Figure 54:
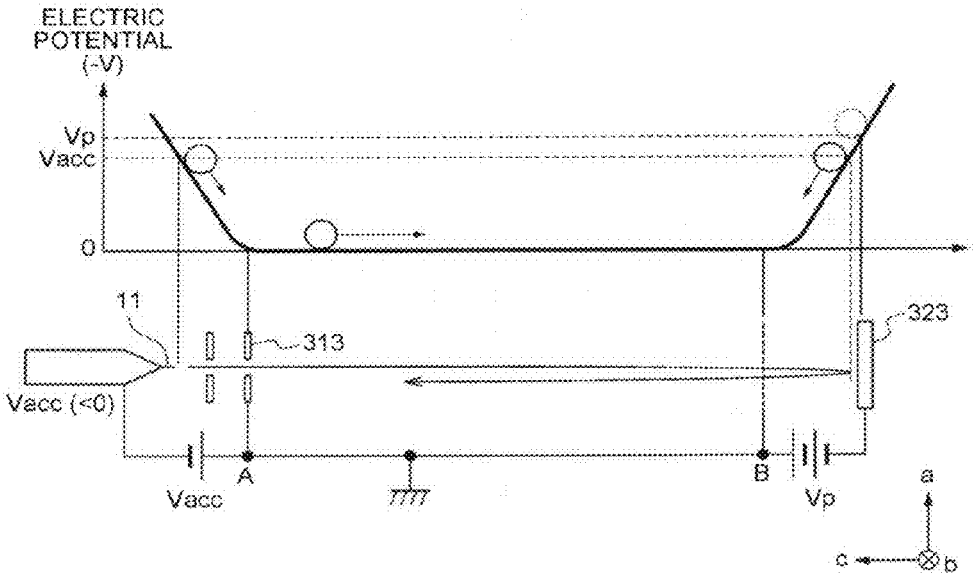
FIG. 54 is a schematic illustrating the behavior of the incident electrons when $|Vacc| < |Vp|$.

FIG. 54 is a schematic illustrating the behavior of the incident electrons when |Vacc|<|Vp|. As illustrated in FIG. 54, when |Vacc|<|Vp|, the incident electrons become decelerated by being affected by the electric potential of the sample 323. The incident electrons then decelerates to zero speed before reaching the sample 323, and then move back in the opposite direction.

In the vacuum with no resistance of the air, the energy conservation law is almost completely established. Therefore, by measuring the conditions in which the energy of the electrons being incident on the surface of the sample 323 becomes zero, that is, in which the landing energy of the incident electrons becomes zero, while changing the energy of the incident electrons, it becomes possible to measure the electric potential on the surface of the sample 323.

Because the amount of electrons reaching the detector 402 is quite different between the secondary electrons generated as the incident electrons hit the sample 323, and the primary repulsive electrons, the identification is possible from the border between the dark and light contrast.

Some scanning electron microscopes include detectors of reflected electrons. The reflected electrons herein generally mean the incident electrons reflected (scattered) backward due to the interaction with the sample material, and emitted from the sample surface.

The energy of the reflected electrons comes near the energy of the incident electrons. The velocity vector of the reflected electrons is generally said to be larger when the atomic number of the sample is larger. The reflected electrons are used in detecting a difference in the compositions of a sample, or irregularity of the sample surface.

By contrast, the primary repulsive electrons are those that are reverted before reaching the sample surface because such electrons are affected by the electric potential distribution of the sample surface, and are completely different from the reflected electrons.

Figure 55:
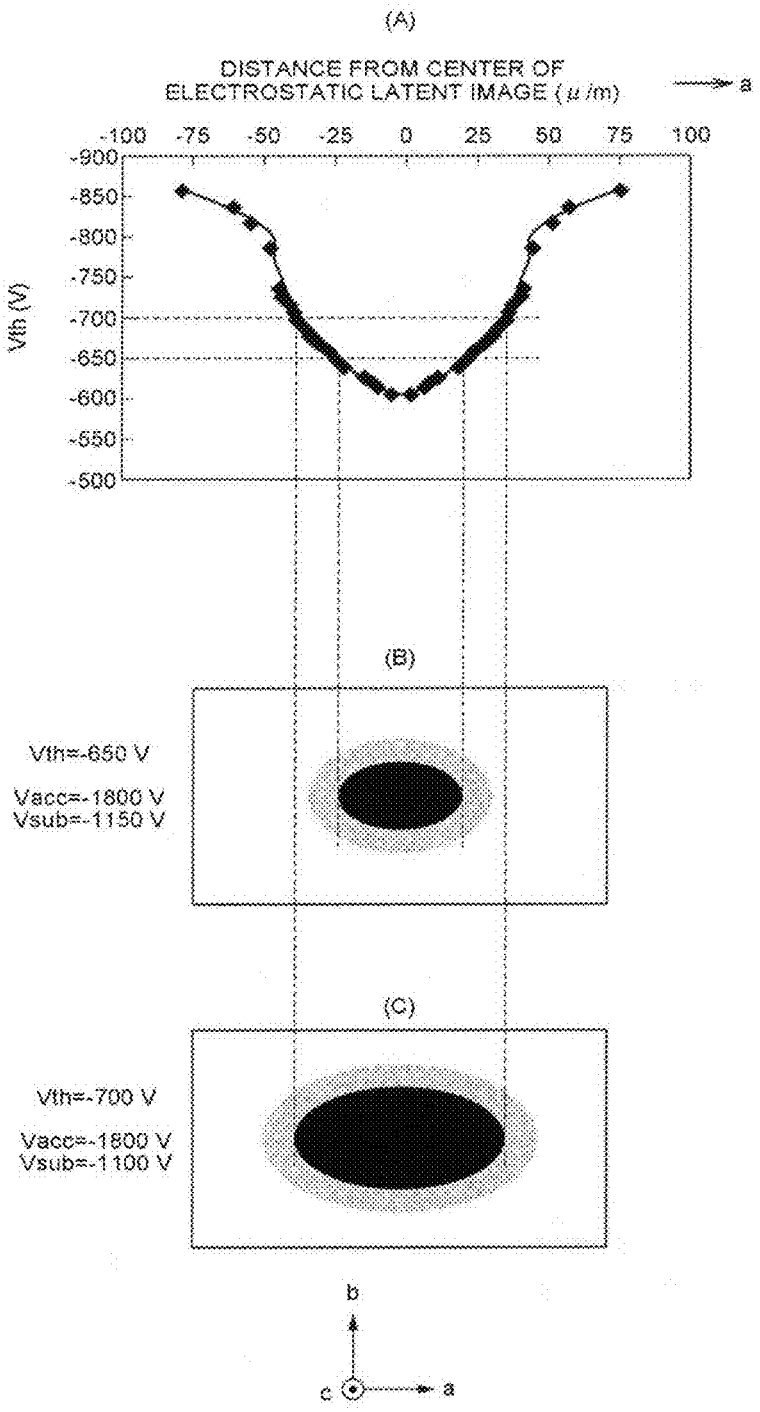
FIG. 55 is a schematic illustrating exemplary measurement results of latent image depth.

FIG. 55 is a schematic illustrating exemplary measurement results of latent image depths. FIG. 55 provides exemplary results of the measurements of an electrostatic latent image. In FIG. 55, Vth denotes the difference between Vacc and Vsub (=Vacc−Vsub).

The electric potential distribution V(a, b) can be acquired from Vth(a, b) of when the landing energy becomes almost zero at each scanned position (a, b). Vth(a, b) has a unique correspondence to an electric potential distribution V(a, b), and when the charge distribution is smooth, Vth(a, b) is approximate equivalent of the electric potential distribution V(a, b).

The curve representing a relation between Vth and a distance from the center of the electrostatic latent image in FIG. 55(*a*) provides an example of the distribution of a surface potential generated by the charge distribution of the sample surface.

In this example, Vacc is set to −1800 volts. The electric potential at the center of the electrostatic latent image is approximately −600 volts. As the position moves away from the center of the electrostatic latent image, the electric potential increases to the negative side. The electric potential of the peripheral area away from the center of the electrostatic latent image by 75 micrometers or more is approximately −850 volts.

FIG. 55(*b*) is a visualized image of an output from the detector 402 when Vsub is set to −1150 volts. At this time, Vth=−650 volts.

FIG. 55(*c*) is a visualized image of an output from the detector 402 when Vsub is set to −1100 volts. At this time, Vth=−700 V.

In the method of acquiring the profile of an electrostatic latent image by detecting the primary repulsive electrons, by scanning the sample surface with the electron beam while changing Vacc or Vsub and measuring the resultant Vth(a, b), the surface potential information of the sample can be acquired. By using this method of acquiring the profile of an electrostatic latent image by detecting the primary repulsive electrons, the profile of the electrostatic latent image can be visualized in the micron order, while such visualization has been conventionally difficult.

In the method of acquiring the profile of an electrostatic latent image by detecting the primary repulsive electrons, because the energy of the incident electrons changes extremely, the trajectory of the incident electrons might be out of its course, thereby causing the scanning magnification to change or lens distortion to occur.

In such a case, the electrostatic field environment or the trajectory of electrons may be calculated in advance, and the detection results may be corrected based on the calculation result, so that the profile of an electrostatic latent image can be calculated highly precisely.

As explained above, with the electrostatic latent image measurement apparatus 300, a charge distribution, a surface potential distribution, an electric field intensity distribution of an electrostatic latent image, and an electric field intensity in the direction perpendicular to the sample surface can be measured highly precisely.

According to an embodiment, a high-image quality image can be formed by controlling an electrostatic latent image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming method comprising:

exposing a surface of an image carrier with a light based on an image pattern including an image portion and a non-image portion to form an electrostatic latent image corresponding to the image pattern, wherein the image portion is made up of a plurality of pixels, some of the pixels that make up the image portion are exposed with light of a first optical output value that is higher than a prescribed optical output value when the entire pixels corresponding to the image portion are exposed over a prescribed time period, and wherein an integrated amount of light on the pixels exposed with light of the first optical output value is equal to an integrated amount of light of the optical output value when the entire pixels corresponding to the image portion is exposed with light of the prescribed optical output value over a prescribed time period.

2. The image forming method according to claim 1, wherein pixels not exposed with light of the first optical output value among the pixels making up the image portion are exposed with light of a second optical output value.

3. The image forming method according to claim 2, wherein the second optical output value is lower than the first optical output value.

4. The image forming method according to claim 2, wherein the pixels exposed with light of the second optical output value are pixels that do not have any image information.

5. The image forming method according to claim 2, wherein the pixels exposed with light of the second optical output value are used for controlling a height of attached toner on the image portion.

6. The image forming method according to claim 1, wherein the entire pixels corresponding to the image portion are exposed with light of the first optical output value for a time period shorter than the prescribed time period.

7. An image forming apparatus that forms an electrostatic latent image corresponding to an image pattern including an image portion made up of a plurality of pixels and a non-image portion by exposing a surface of an image carrier with light based on the image pattern, the image forming apparatus comprising:

a light source that outputs the light;

a light source driving unit that generates a light source driving current for driving the light source; and an optical system that guides the light output from the light source to the latent image carrier, wherein the light source driving unit generates the light source driving current such that some of the pixels making up the image portion is exposed with light of a first optical output value that is higher than a prescribed optical output value when the entire pixels corresponding to the image portion are exposed over a prescribed time period, and wherein an integrated amount of light on the pixels exposed with light of the first optical output value is equal to an integrated amount of light of the optical output value when the entire pixels corresponding to the image portion is exposed with light of the prescribed optical output value over a prescribed time period.

8. The image forming apparatus according to claim 7, wherein the light source driving unit generates the light source driving current such that pixels not exposed with light of the first optical output value among the pixels making up the image portion are exposed with light of a second optical output value.

9. The image forming apparatus according to claim 8, wherein the second optical output value is lower than the first optical output value.

* * * * *